US007900643B2

(12) United States Patent
Ma

(10) Patent No.: US 7,900,643 B2
(45) Date of Patent: Mar. 8, 2011

(54) HUBS FOR SHADE STRUCTURES

(76) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 11/850,640

(22) Filed: Sep. 5, 2007

(65) Prior Publication Data

US 2008/0066793 A1 Mar. 20, 2008

Related U.S. Application Data

(60) Provisional application No. 60/842,472, filed on Sep. 5, 2006.

(51) Int. Cl.
*A45B 25/02* (2006.01)

(52) U.S. Cl. ..... 135/28; 135/29

(58) Field of Classification Search ..... 135/28, 135/29, 20.3

See application file for complete search history.

(56) References Cited

U.S. PATENT DOCUMENTS

| | | | | |
|---|---|---|---|---|
| 229,685 | A * | 7/1880 | Ege | 135/28 |
| 521,222 | A | 6/1894 | Schof et al. | |
| 620,815 | A | 3/1899 | Warren | |
| 776,352 | A * | 11/1904 | Rogers | 135/27 |
| 928,169 | A | 7/1909 | Bardon | |
| 1,001,076 | A | 8/1911 | Redford | |
| 1,207,649 | A | 12/1916 | South | |
| D56,043 | S | 8/1920 | Weinberg et al. | |
| 1,712,430 | A * | 5/1929 | Giszczynski | 135/39 |
| 1,908,453 | A | 5/1933 | Schmidt | |
| 2,168,188 | A | 8/1939 | Bernhard | |
| 2,185,466 | A | 1/1940 | Jostes | |
| 2,474,516 | A | 6/1949 | Daniel | |
| 2,507,919 | A | 5/1950 | Mazzeo | |
| 2,661,752 | A | 12/1953 | Kampf et al. | |
| 2,705,967 | A | 4/1955 | Zimmermann et al. | |
| 2,860,647 | A | 11/1958 | Negri | |
| 2,906,277 | A | 9/1959 | Militano | |
| 3,016,910 | A | 1/1962 | Rosenkaimer | |
| 3,672,381 | A | 6/1972 | Kida et al. | |

(Continued)

FOREIGN PATENT DOCUMENTS

AU 702 172 B2 2/1999

(Continued)

OTHER PUBLICATIONS

U.S. Appl. No. 11/850,628, filed Sep. 5, 2007, Ma.

(Continued)

*Primary Examiner* — David Dunn
*Assistant Examiner* — Noah Chandler Hawk
(74) *Attorney, Agent, or Firm* — Knobbe, Martens, Olson & Bear, LLP

(57) ABSTRACT

An umbrella is provided that comprises a pole, ribs, an uppermost hub, a hub below the uppermost hub, and at least one handle. The hub below the uppermost hub comprises a first hub component and a second hub component each comprising alternating recesses and projections extending substantially radially with respect to the longitudinal axis of the pole and being configured to receive ribs of the umbrella. The handle can be operably connectable with the uppermost hub and the second hub component, and downward movement of the handle causes downward movement of the uppermost hub and the upward movement of ends of a first plurality of ribs. Further, upward movement of the second hub component causes upward movement of ends of the second plurality of ribs relative to the ends of the first plurality of ribs to modify a profile of the canopy.

20 Claims, 20 Drawing Sheets

U.S. PATENT DOCUMENTS

| | | | | |
|---|---|---|---|---|
| 3,828,805 | A | 8/1974 | Thur | |
| 4,030,514 | A | 6/1977 | Schultes | |
| 4,080,976 | A | 3/1978 | Hirai | |
| 4,144,900 | A | 3/1979 | Kinski | |
| 4,474,200 | A | 10/1984 | Kida | |
| 4,474,201 | A | 10/1984 | Kida | |
| 4,697,606 | A | 10/1987 | Ma | |
| 4,763,679 | A | 8/1988 | Lerch | |
| 5,036,872 | A | 8/1991 | Huang | |
| 5,329,953 | A | 7/1994 | Becher | |
| 5,483,985 | A | 1/1996 | Yu | |
| 5,564,453 | A | 10/1996 | Steiner | |
| 5,617,888 | A | 4/1997 | Wu | |
| 5,640,984 | A | 6/1997 | Dubunsky | |
| 5,655,557 | A | 8/1997 | Martin | |
| 5,740,824 | A * | 4/1998 | Tang | 135/28 |
| 5,752,534 | A | 5/1998 | Becher | |
| 5,842,493 | A | 12/1998 | Yakubisin | |
| 5,884,645 | A * | 3/1999 | Chen et al. | 135/25.1 |
| 6,039,063 | A | 3/2000 | Lin et al. | |
| 6,076,540 | A | 6/2000 | You | |
| 6,082,383 | A | 7/2000 | Wilson | |
| 6,095,169 | A | 8/2000 | Lin et al. | |
| 6,196,244 | B1 | 3/2001 | Haddad et al. | |
| 6,311,707 | B1 * | 11/2001 | Wu et al. | 135/28 |
| 6,374,840 | B1 | 4/2002 | Ma | |
| 6,386,214 | B1 * | 5/2002 | Clarke | 135/20.3 |
| 6,390,107 | B1 | 5/2002 | Lin et al. | |
| 6,626,199 | B2 | 9/2003 | Lin et al. | |
| D497,478 | S | 10/2004 | Clarke | |
| 7,401,618 | B2 * | 7/2008 | Caldwell | 135/33.7 |
| 2003/0005952 | A1 | 1/2003 | Chen | |
| 2003/0098050 | A1 | 5/2003 | Lee | |
| 2004/0035452 | A1 | 2/2004 | Ma | |
| 2004/0055628 | A1 | 3/2004 | Yu | |
| 2004/0182429 | A1 | 9/2004 | Chen | |
| 2005/0028853 | A1 | 2/2005 | Houtan | |
| 2005/0045217 | A1 | 3/2005 | Clarke | |
| 2006/0090784 | A1 | 5/2006 | Ma | |
| 2006/0151018 | A1 | 7/2006 | Wilson | |
| 2008/0066791 | A1 | 3/2008 | Ma | |

FOREIGN PATENT DOCUMENTS

| | | | |
|---|---|---|---|
| DE | 580503 | | 7/1933 |
| DE | 203 06 406 | U1 | 7/1994 |
| DE | 20 2005 011579 | U1 | 7/2006 |
| EP | 0 392 989 | | 3/1990 |
| EP | 1 654 952 | | 5/2006 |
| EP | 1654952 | A1 | 5/2006 |
| FR | 2 554 490 | A | 5/1985 |
| GB | 22218 | A | 9/1910 |
| NL | 9 500 219 | A | 9/1996 |
| WO | WO 2006/076270 | | 7/2006 |
| WO | WO 2007/018492 | A | 2/2007 |

OTHER PUBLICATIONS

International Search Report and Written Opinion in co-pending PCT Application No. PCT/US2007/077668, mailed Jan. 29, 2008.

International Search Report and Written Opinion in corresponding PCT Application No. PCT/US2007/077673, mailed Jan. 29, 2008.

European Search Report dated Mar. 20, 2006 regarding Application No. EP 05255342.7-2313.

Preliminary Report on Patentability of Corresponding PCT Application No. PCT/US2007/077673, mailed Mar. 19, 2009, 7 pages.

Preliminary Report on the Patentability of Corresponding PCT Application No. PCT/US2007/077668, mailed Mar. 19, 2009, 8 pages.

* cited by examiner

HUBS FOR SHADE STRUCTURES

This application claims the benefit of U.S. Provisional Application No. 60/842,472, filed Sep. 5, 2006, the entirety of which is hereby incorporated herein by reference.

BACKGROUND

1. Field

This invention is concerned with shade structures, such as umbrellas, particularly large free-standing umbrellas, which have at least one hub that carries a plurality of ribs and which is separable into at least two hub components, each carrying a set of ribs. The hub components of each of the relevant hub(s) are nestable together to provide new combinations of rib geometry that are particularly useful in umbrellas having more efficient operating characteristics and/or variable geometry.

2. Description of the Related Art

Shade structures, and in particular umbrellas, have long been known that comprise a pole supporting a set of ribs to which is attached a fabric canopy and having a mechanism mounted to the pole that operates to extend or retract the ribs and thereby raise or lower the canopy.

As use of outdoor restaurants, patios and gardens and the like becomes more popular, so there is an increasing demand for shade structures that are more flexible, visually appealing or offer enhanced features or ease of operation.

SUMMARY

According to one embodiment the invention there are provided shade structures, preferably umbrellas, comprising a hub assembly having a plurality of hub components, each carrying a set of ribs, and being movable with respect to each other from a position in which they are nested, embedded or otherwise associated with each other to a position in which they are separated.

Thus, the hub components of each of the relevant hub(s) are nestable together to provide new combinations of rib geometry that are particularly useful in umbrellas having more efficient operating characteristics and/or variable geometry. The nesting feature also contributes to more efficient operation and less complex structure where the umbrella comprises multiple hubs, such as two, three or four and at least one of the hubs is a nested hub in accordance with the invention.

The hub components may comprise a master hub component that contributes to the opening or deployment of the umbrella canopy and the other hub components are then separated, preferably sequentially, to alter the shape of the canopy.

One embodiment of the invention provides a method of operating an umbrella, which umbrella comprises an uppermost hub having attached thereto a set of ribs and a canopy supported thereon, and a lower hub separable into at least two hub components, each of the hub components having attached thereto its own set of ribs, the method comprising the steps of: opening the set of ribs attached to the uppermost hub, so as to move the canopy supported on the ribs to a first umbrella shape; moving at least one of the separable hub components from a position in which the hub components are nested together to a position in which the at least one separable hub component separates from being nested together with the other hub component(s), so as to move the set of ribs associated with the separable hub component and change the shape of the umbrella. In the method there may be two, three or four separable hub components.

Such a method is applicable to the structural embodiments described herein. The uppermost hub and each of the hub components may be operated by crank and pulley arrangements or, preferably, a corresponding number of the track mechanisms described herein.

In a preferred embodiment of the invention, there is provided an umbrella comprising: a support pole; a first hub attached to the support pole and having a plurality of ribs extending from the hub, the ribs supporting a canopy and being movable from a stowed position in which the canopy is substantially closed to an extended position in which the canopy is substantially open; at least one additional hub extending around the support pole at a location below the first hub, the additional hub comprising: a first hub component having a plurality of ribs extending therefrom; at least one other, preferably a second or second and third, hub component having a plurality of ribs extending therefrom; the first and at least one other hub components being movable with respect to each other from a position in which they are nested or embedded together to another position in which they are separated from one another.

In one embodiment, the ribs of the first and at least one other (such as second or third) hub components are connected to their respective hub components so that they each pivot about a pivot point and wherein the pivot points of the ribs of the first hub component and at least one other hub component are in substantially the same plane when the hub components are nested or embedded together.

Each of the first and other hub components may have at least one projection element and at least one nesting recess, so that the hub components can be nested or embedded together by interaction of the respective projection element(s) and nesting recess(es).

Desirably, the first and other hub components may have complementary shapes, so that when they are nested or embedded together they form an overall external shape that looks like a single hub.

In some preferred embodiments of the invention, the additional hub may comprise two, three or four hub components. Typically, these hubs will comprise a master hub component. The master hub preferably is a hub component carrying the most ribs compared to the other hub components. The master hub component typically is the principal component of the nested hub arrangement into which the other hub component or components nest. Thus, preferably, the master hub component comprises a body extending around the umbrella pole and having formed therein a plurality of radially extending recesses. Some of the recesses accept ribs and other of the recesses accept other hub components for nesting. Preferably the master hub component has two or four recesses for receiving for nesting rib-carrying projections elements of one or more hub components. Such master hub components may carry six or four, respectively, ribs of its own.

In an embodiment, the additional hub has two hub components: ie first and second hub components. The first hub component is preferably in an upper position with respect to the second hub component when the umbrella is erected and the second hub component has a number of projection elements corresponding to the number of ribs that the additional hub carries. Each projection element of the second hub component may comprise a pair of opposing walls defining a space between them for receiving a rib. The first hub component may be in an upper position with respect to the second hub component when the umbrella is erected and the first hub component has fewer ribs than the second hub component, For example, the first hub component preferably has two ribs and the second hub component has four ribs.

In another embodiment the additional hub comprises three hub components: an upper hub component; an intermediate hub component; and a lower hub component. At least one of these hub components may be a master hub component. The master hub component may carry more ribs than each of the other two hub components. As before, the master hub component preferably comprises a series of radially extending recesses and projections, the recesses comprising some for receiving ribs and others for receiving the other hub components so as to form a nested hub. Various permutations of both the number of ribs carried by each hub component and the vertical arrangement of the hub components on the umbrella pole are contemplated by this invention. For example, the master hub component may be either the intermediate or upper hub component. Preferably the master hub component carries four ribs and each of the other two hub components carries two ribs each.

Another embodiment of the invention provides an umbrella, comprising a pole having a longitudinal axis and an upper hub with a plurality of ribs extending therefrom for supporting a shade canopy; a hub below the upper hub when the umbrella is erected and comprising separable hub components, comprising a first hub component having an outline shape extending around the pole and comprising a series of projections extending substantially radially with respect to the longitudinal axis and alternating with a series of substantially radially extending recesses formed between the projections, some of the recesses being adapted to receive ribs for directly or indirectly supporting the umbrella canopy and some other of the recesses being adapted to receive, when the hub components are not separated, at least one other (such as a second or second and third) hub component comprising a plurality of yolk elements extending substantially radially with respect to the longitudinal axis of the pole, the yolk elements being configured to nest together with the other recesses of the first hub component and provide recesses adapted to receive a set of ribs carried by the at least one other hub component(s).

In the umbrella, the ribs of the first and at least one other hub components may be connected to their respective hub components so that they each pivot about a pivot point and wherein the pivot points of the ribs of the first hub component and at least one other hub component(s) are in substantially the same plane when the hub components are nested or embedded together.

Another embodiment of the invention provides an umbrella, comprising a pole having a longitudinal axis and an upper hub with a plurality of ribs extending therefrom for supporting a shade canopy; a hub below the upper hub when the umbrella is erected and comprising separable hub components, comprising a first hub component having an outline shape extending around the pole and comprising a series of projections extending substantially radially with respect to the longitudinal axis and alternating with a series of substantially radially extending recesses formed between the projections, some of the recesses being adapted to receive ribs for directly or indirectly supporting the umbrella canopy and some other of the recesses being adapted to receive, when the hub components are not separated, at least one other (such as a second or second and third) hub component comprising a plurality of yoke elements extending substantially radially with respect to the longitudinal axis of the pole, the yoke elements being configured to nest together with the other recesses of the first hub component and provide recesses adapted to receive a set of ribs carried by the at least one other hub component(s).

In one embodiment, the at least one other hub has two hub components. The first hub component may be in an upper position with respect to the second hub component when the umbrella is erected and the second hub component has a number of yolk elements corresponding to the number of ribs that it carries. The first hub component may have two ribs and the second hub component four ribs.

In another embodiment the additional hub comprises three hub components and an upper hub component; an intermediate hub component; and a lower hub component. At least one of these hub components may be a master hub component. The master hub component may carry more ribs than each of the other two hub components. As before, the master hub component preferably comprises a series of radially extending recesses and projections, the recesses comprising and projections, the recesses comprising some for receiving ribs and others for receiving the other hub components so as to form a nested hub. Various permutations of both the number of ribs carried by each hub component and the vertical arrangement of the hub components on the umbrella pole are contemplated by this invention. For example, the master hub component may be either the intermediate or upper hub component. Preferably the master hub component carries four ribs and each of the other two hub components carries two ribs each.

In one embodiment, the at least one other hub has two hub components. The first hub component may be in an upper position with respect to the second hub component when the umbrella is erected and the second hub component has a number of yoke elements corresponding to the number of ribs that it carries. The first hub component may have two ribs and the second hub component four ribs.

In the umbrellas of the invention the pole may comprise an outer surface and one or more elongate channels recessed in the outer surface. Each channel may comprise an actuating handle and an elongate member disposed in said elongate channel, the elongate member being coupled with a hub, wherein after the canopy has been moved to an open position, the actuating handle can be movable to move a second hub to alter the configuration of the canopy.

Some preferred embodiments of the invention will now be described by reference to the accompanying drawings.

BRIEF DESCRIPTION OF THE DRAWINGS

The above mentioned and other features of the inventions disclosed herein are described below with reference to the drawings of some preferred embodiments. The illustrated embodiments are intended to illustrate, but not to limit the invention. The drawings contain the following figures.

DETAILED DESCRIPTION

Figure 1:
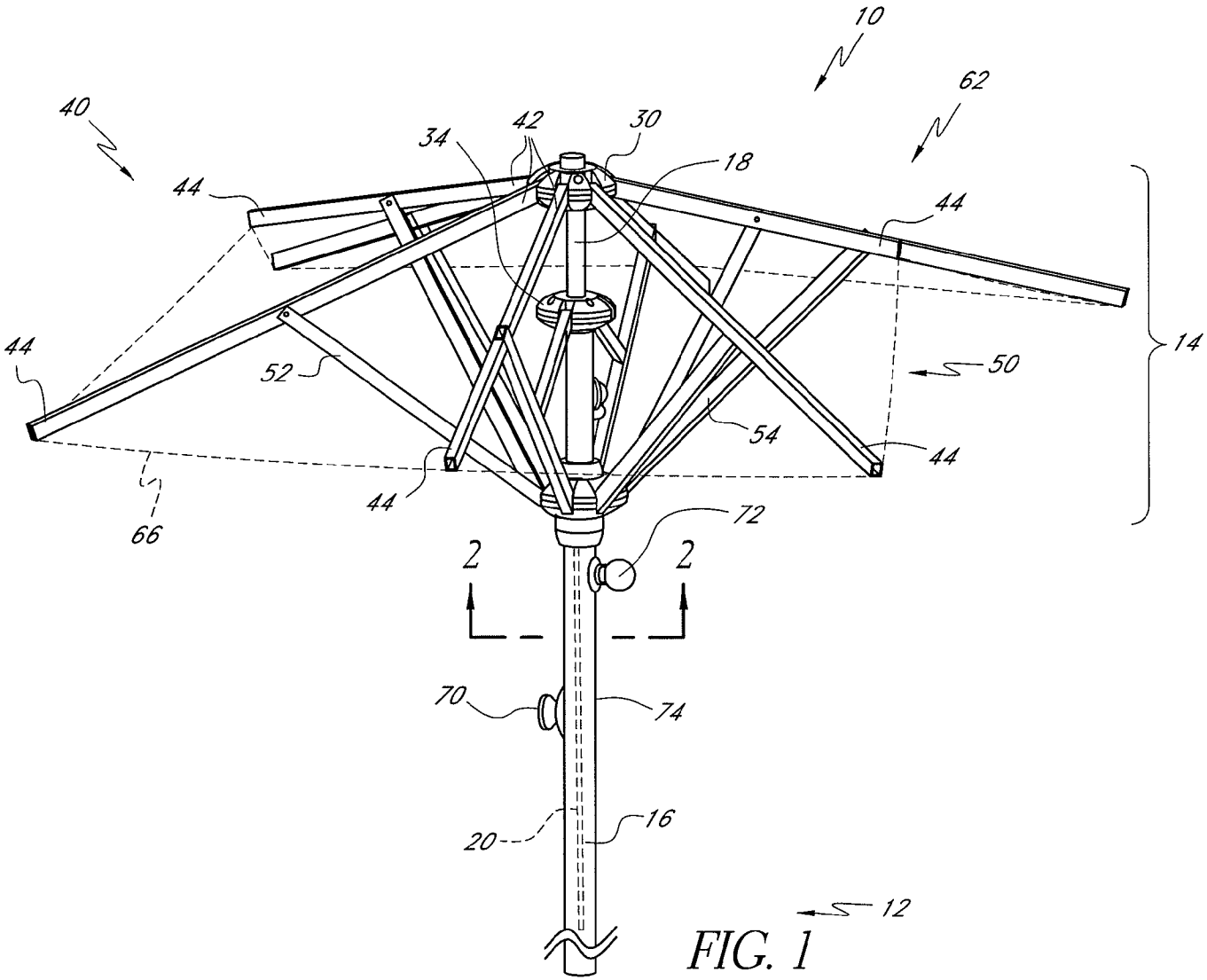
FIG. 1 is a perspective view of an umbrella according to the invention.

Referring now to the drawings, which illustrate some preferred embodiments of the present invention, and are not for limiting the same, a uniquely configured umbrella 10 is provided. As will be shown with reference to the drawings, a preferred embodiment of the umbrella 10 can be adjusted between a closed position, an open position, and an extended position utilizing innovative mechanisms and techniques which are discussed in greater detail below.

FIGS. 1-6 illustrate some umbrellas that are preferred for use with the hub arrangement of the invention, but it will be understood that these hub arrangements are useful in other umbrellas.

Figure 4:
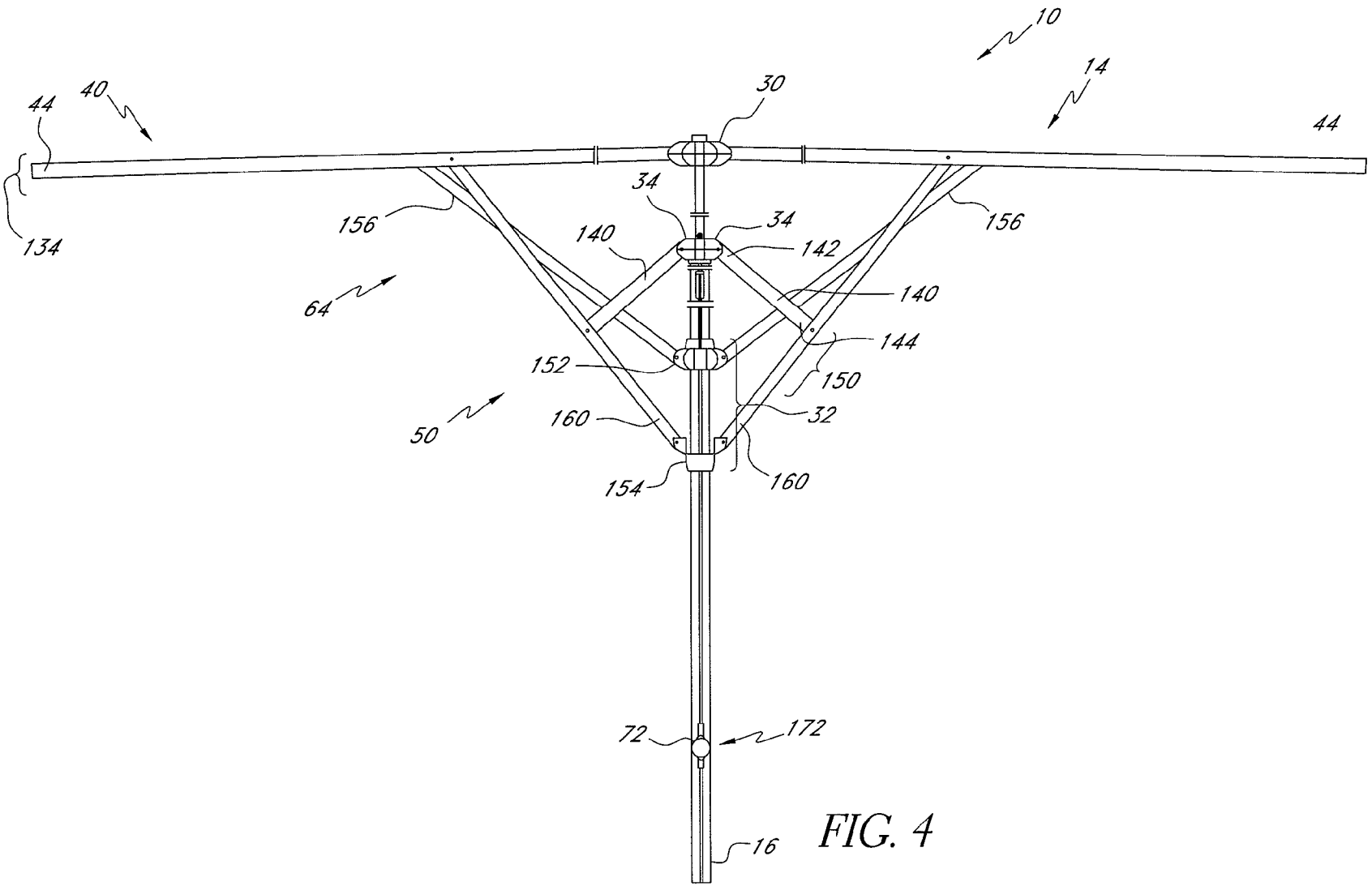
FIG. 4 is a plan view of an umbrella according to the invention, showing the umbrella in a second open position.
Figure 5:
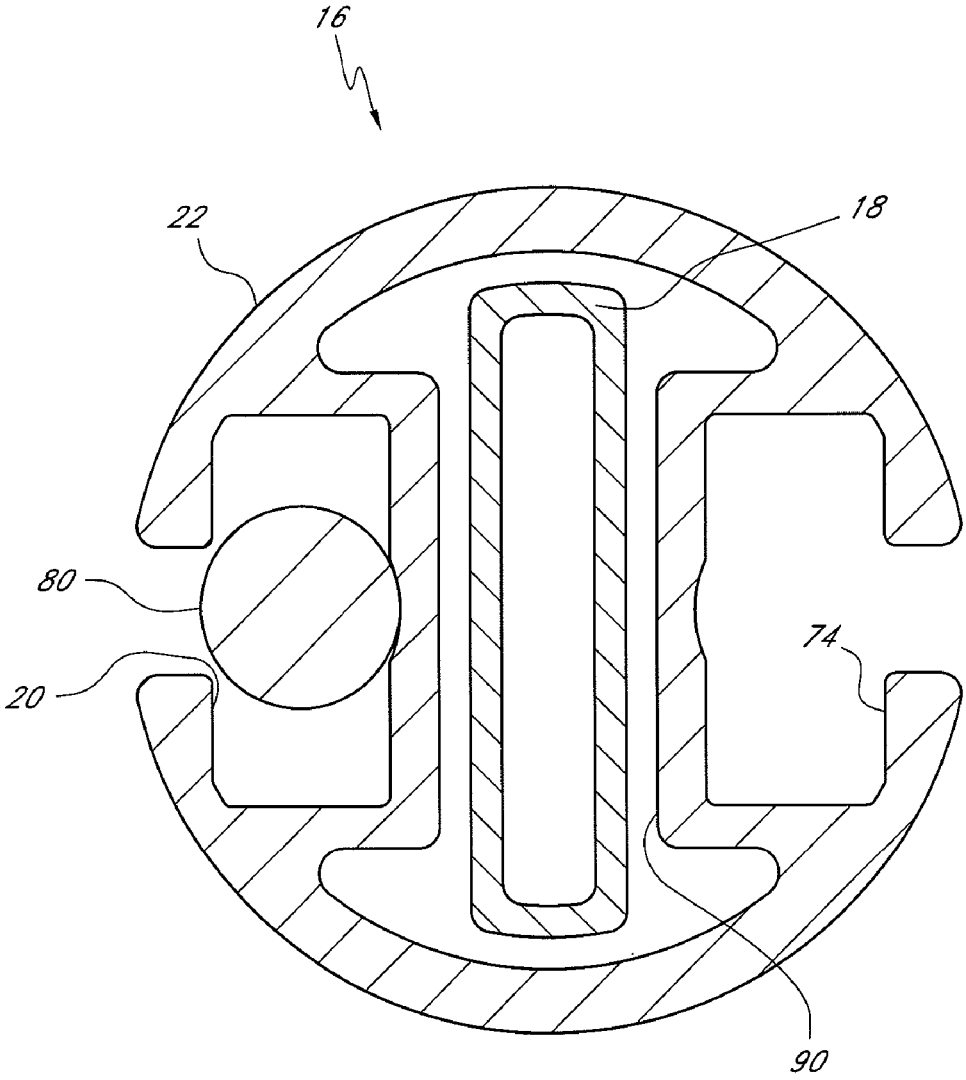
FIG. 5 is a cross-sectional view of the umbrella shown in FIG. 3, taken along the lines 5-5.

According to an embodiment illustrated in FIG. 1, the umbrella 10 can include a support pole assembly 12. The support pole assembly 12 can be configured to include at least one pole, and preferably comprises a lower pole 16 and an upper pole 18. The upper pole 18 can be translatable relative to the lower pole 16. In addition, the lower pole 16 can be configured to include at least one first elongate channel 20. Although it is contemplated that the first elongate channel 20 can be formed separately from the lower pole 16, the elongate channel 20 can be at least partially recessed in an outer surface 22 of the lower pole 16, as shown in FIGS. 1, 4, and 5.

Referring still to FIG. 1, the umbrella 10 can further include a canopy support frame 14 that can be configured to include a first hub 30, a second hub 32, and an intermediate hub 34. Additionally, the canopy support frame 14 can include a first plurality of ribs 40 that can each define a first end 42 and a second end 44. According to an implementation of the present invention, the first ends 42 of the first plurality of ribs 40 can be coupled with the first hub 30 such that the second ends 44 are disposed away from the first hub 30. Furthermore, the canopy support frame 14 can further include a second plurality of ribs 50. Each of the second plurality of ribs can define a first end 52 and a second end 54. In this regard, it is contemplated that the first ends 52 of the second plurality of ribs 50 can be coupled to the second hub 32. Additionally, the second ends 52 of the second plurality of ribs can each be coupled to a respective rib of the first plurality of ribs 40 such that the first plurality of ribs 40 can be operatively coupled to the second plurality of ribs 50 in forming the canopy support frame 14, according to an implementation of the present invention.

Figure 2:
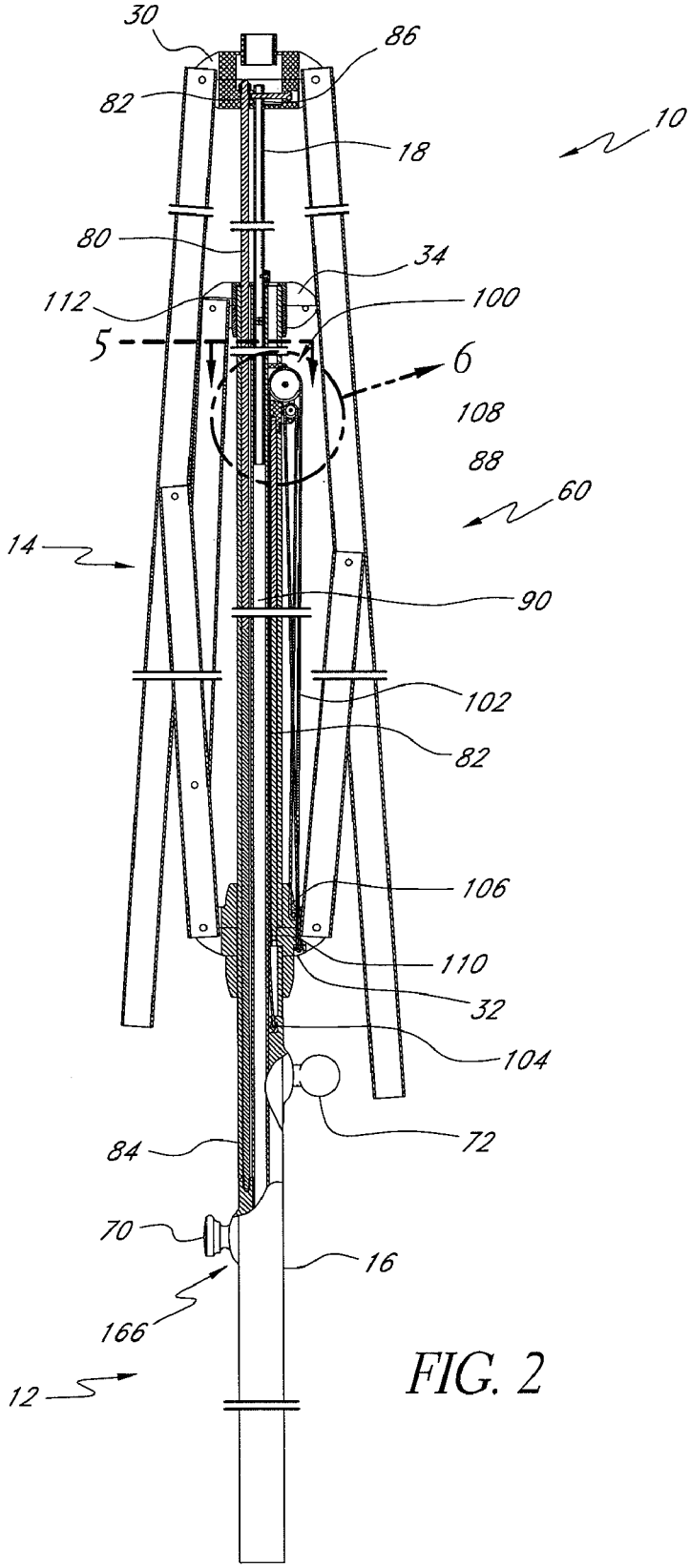
FIG. 2 is a plan view of an umbrella according to the invention, partly cut away and showing the umbrella in a closed position
Figure 3:
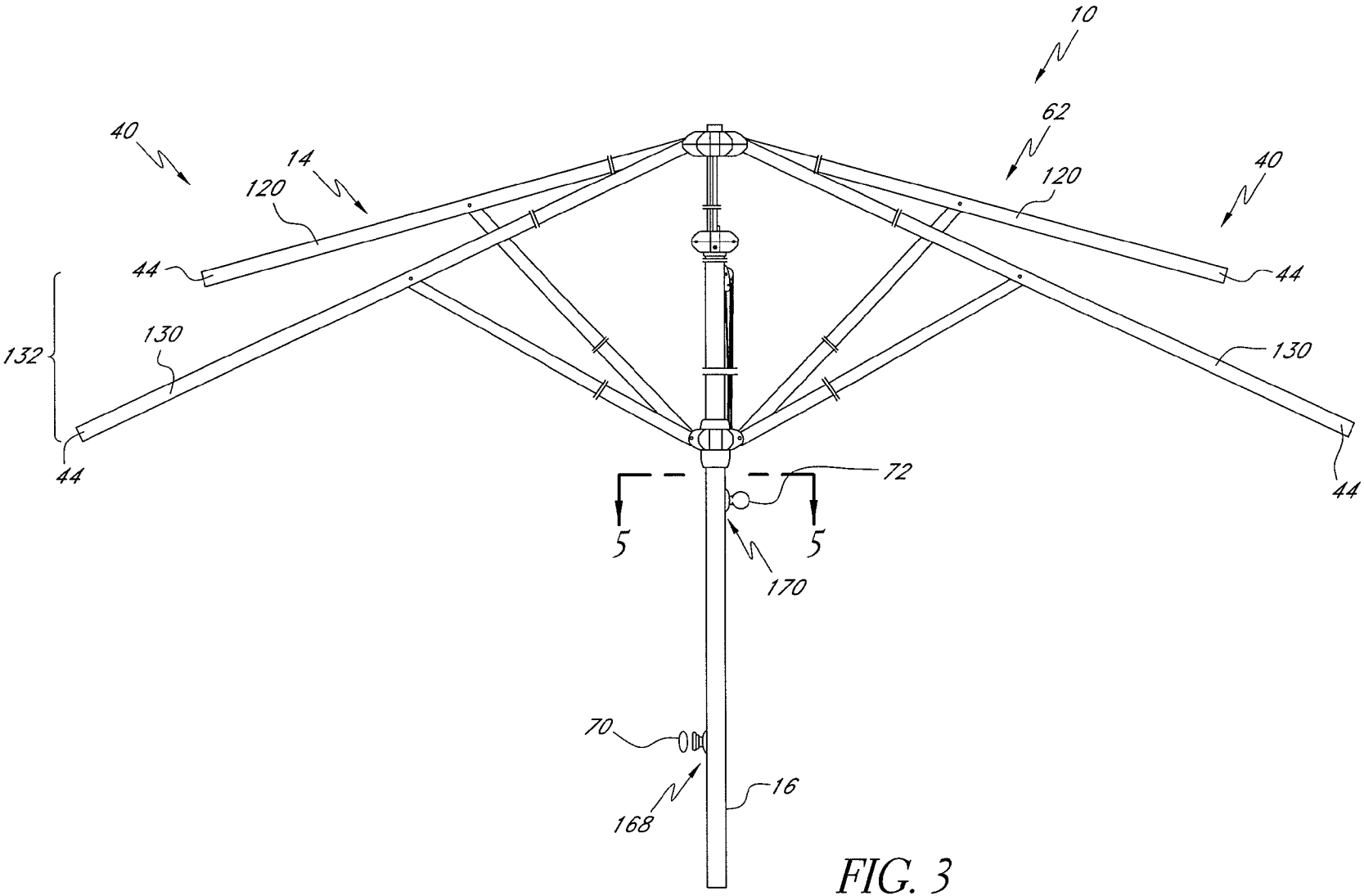
FIG. 3 is plan view of an umbrella according to the invention, showing the umbrella in a first open position.

In accordance with an aspect of the present invention, the canopy support frame 14 of the umbrella 10 can be moved from a closed position 60 (shown in FIG. 2) to an open position 62 (shown in FIGS. 1 and 3). In some implementations, the canopy support frame 14 can be operative to move to an extended position 64 (shown in FIG. 4). Additionally, as shown in hidden lines in FIG. 1, the canopy support frame 14 can be used to support a canopy 66, which can be coupled to the canopy support frame 14 in such a manner as to ensure that the canopy 66 can be manipulated in shape in response to the movement of the canopy support frame 14. In this regard, the canopy 66 can comprise one or more individual canopy portions that collectively form the canopy 66. It is contemplated that the canopy 66 can therefore have a variety of possible configurations, shapes, and other features that may be beneficial in using the umbrella 10. Such modifications are contemplated as being within the scope of embodiments of the present invention.

Referring still to FIG. 1, the umbrella 10 can comprise at least a first actuating handle 70 that is operative to manipulate the configuration of the canopy support frame 14. According to an implementation, movement of the first actuating handle 70 can produce a corresponding movement of the canopy support frame 14 from the closed position 60 to the open position 62. For example, the first actuating handle 70 can be vertically translated along the lower pole 16 in order to effectuate movement of the canopy support frame 14 from the closed position 60 to the open position 62. In this regard, according to an embodiment of the present invention, it is contemplated that the first actuating handle 70 can be at least partially disposed within the first elongate channel 20 of the lower pole 16 in order to facilitate translatable vertical movement of the first actuating handle 70 along the lower pole 16. The lower or main pole 16 extends downwardly into a base (not shown).

According to another aspect of the present invention, the umbrella 10 can further comprise a second actuating handle 72. As illustrated in FIG. 1, the second actuating handle 72 can be separate from the first actuating handle 70. For example, the first actuating handle 70 can be disposed opposite the second actuating handle 72. In an implementation of the present invention, movement of the second actuating handle 72 can produce a corresponding movement of the canopy support frame 14 from the open position 62, shown in FIGS. 1 and 3, to the extended position 64, shown in FIG. 4.

Similar to the first actuating handle 70, although the movement of the second actuating handle 72 can be any one of a variety of movements, it is contemplated that the second actuating handle 72 can be configured to be vertically translatable in order to effectuate the corresponding movement of the canopy support frame 14 from the open position 62 to the extended position 64. In particular, the lower pole 16 can further include a second elongate channel 74.

Similar to the first elongate channel 20, the second elongate channel 74 can be separate from the lower pole 16. In an implementation of the present invention, the second elongate channel 74 can be at least partially recessed in the outer surface 22 of the lower pole 16. Therefore, in accordance with an aspect of the present invention, the second actuating handle 72 can be sized and configured to be at least partially disposed within the second elongate channel 74 in order to facilitate translatable movement of the second actuating handle 72 along the lower pole 16.

Referring now to FIG. 2, the umbrella 10 is shown in the closed position 60. Further, FIG. 2 provides a partial cross-sectional view along an axis of the support pole assembly 12. As shown therein, the umbrella 10 can further include a first elongate member 80. The first elongate member 80 can be disposed in parallel relation relative to the support pole assembly 12. However, the first elongate member 80 can preferably be at least partially disposed within the first elongate channel 20.

According to an implementation of the present invention, the first elongate member 80 can define an upper end 82 and a lower end 84. The lower end 84 of the first elongate member 80 can be coupled with the first actuating handle 70, and the upper end 82 of the first elongate member 80 can be coupled to the first hub 30. The first elongate member 80 can be made of a variety of materials, such as metal, plastic, and can be elastic or inelastic. However, in a preferred embodiment, the first elongate member 80 can be fabricated from a substantially rigid material such that a position of the first hub 30 can be fixed relative to a position of the first actuating handle 70.

Therefore, as illustrated in FIG. 2, and as further described below with reference to FIG. 5, the first elongate member 80 can preferably be a compression member such as a cylindrical or other shaped rod that provides a coupling between the first hub 30 and the first actuating handle 70 in order to ensure that the distance between the first hub 30 and the first actuating handle 70 is relatively constant. In this regard, vertical displacement of the first actuating handle 70 can therefore result in a corresponding vertical displacement of the first hub 30. As described further below, upon translating the first actuating handle 70 downwardly along the lower pole 16, the first hub 30 can likewise be translated downwardly, and due to the configuration of the canopy support frame 14, the canopy support frame can be moved from the closed position 60 to the open position 62.

According to another aspect of the present invention, the upper pole 18 of the support pole assembly 12 can be configured to provide stability to the first hub 30 and to ensure that the first hub 30 translates axially relative to the support pole assembly 12. As illustrated in FIG. 2, the upper pole 18 can define an upper end 86 and a lower end 88. The upper end 86 can be coupled to the first hub 30 and the lower end 88 can be slidable within a central passage 90 of the lower pole 16. In this regard, the upper pole 18 is preferably sized and configured to ensure that the lower end 88 is maintained within the central passage 90 of the lower pole 16 during all translational movement of the first hub 30.

According to yet another aspect of the present invention, the umbrella 10 can further comprise a pulley assembly 100. The pulley assembly 100 can be used to operatively interconnect the second actuating handle 72 with the second hub 32 in order to facilitate movement of the canopy support frame 14 from the open position 62 to the extended position 64. As shown in FIG. 2, the second actuating handle 72 can be interconnected to the second hub 32 via a tension member 102. The tension member 102 can define a first end 104 that can be coupled to the second actuating handle 72, and a second end 106 that can be coupled to the second hub 32. According to an implementation of the present invention, the tension member 102 can be a wire or other flexible cord and can extend upwardly from the second actuating handle 72 to engage the pulley assembly 100 and then descend downwardly toward the second hub 32. A more detailed description of an exemplary configuration and operation of the pulley assembly 100 and the tension member 102 are provided below.

Referring still to FIG. 2, the umbrella 10 can further comprise a second elongate member 82. The second elongate member 82 can define an upper end 108 and a lower end 110. As mentioned above with respect to the first elongate member 80, the second elongate member 82 can also be fabricated from a similar variety of materials. Preferably, the second elongate member 82 is fabricated from a material. Thus, as shown in FIG. 2, the second elongate member 82 can be utilized to ensure that an axial position of the pulley assembly 100 is in fixed relation relative to at least a portion of the second hub 32.

In this regard, the lower end 110 of the second elongate member 82 can be coupled to at least a portion of the second hub 32 and the upper end 108 of the second elongate member 82 can be coupled to the pulley assembly 100. As described in greater detail below, such an embodiment of the present invention can be beneficially used with a "split" or "nested" second hub 32, which will be described further below. Nevertheless, it is contemplated that other embodiments of the present invention can be fabricated without the use of the second elongate member 82. Further, in such alternative embodiments, the pulley assembly 100 can be fixed relative to the lower pole 16 in order to ensure that the second hub 32 can be moved in response to the movement of the second actuating handle 72.

As illustrated in FIG. 2, it is contemplated that at least one of the first hub 30, the second hub 32, and the intermediate hub 34 can be sized and configured to be vertically translatable relative to the support pole assembly 12. For example, as mentioned above, the first hub 30 can be vertically translatable relative to the lower pole 16 of the support pole assembly 12, with the upper pole 18 tending to ensure that the first hub 30 can be stabilized and axially translated with respect to the lower pole 16. In addition, it is contemplated that at least a portion of the second hub 32 can be vertically translatable along the lower pole 16. As will be described in greater detail below, various embodiments of the present invention can incorporate different configurations of the second hub 32 which can provide varying degrees of relative movement of portions of the second hub 32.

According to a preferred embodiment, the intermediate hub 34 can be positioned in a fixed relationship relative to the lower pole 16. For example, the intermediate hub 34 can be coupled to a top end 112 of the lower pole 16. Nevertheless, it is contemplated that other configurations of the umbrella 10 can provide that the intermediate hub 34 be vertically translatable with respect to the lower pole 16. Exemplary operation of the first hub 30, the second hub 32, and the intermediate hub 34 are described in greater detail below.

Referring now to the front plan view of FIG. 3, the umbrella 10 is shown in the open position 62. The view of the umbrella in FIG. 3 provides only a partial illustration of the canopy support frame 14. In accordance with an aspect of the present invention, the canopy support frame 14 can be configured such that the first and second pluralities of ribs 40, 50 can combine to form a non-uniform configuration.

In this regard, as shown in FIG. 3, the canopy support frame 14 can be configured to include at least one up member 120 and at least one down member 130. Each of the up and down members 120, 130 can be individually comprised of at least one of the first plurality of ribs 40 and at least one of the second plurality of ribs 50. In one implementation, the canopy support frame 14 can include two up members 120 (both shown in FIG. 3) and six down members 130 (wherein only two are visible in FIG. 3). As shown in FIG. 3, in the open position 62, the second ends 44 of each of the up members 120 can be positioned at a same or greater height or elevation than the second ends 44 of the down members 130.

According to an aspect of the present invention, movement of the first actuating handle 70 can cause the canopy support frame to move from the closed position 60 to the open position 62 illustrated in FIG. 3. For example, upon being raised to the open position 62, the second ends 44 of the first plurality of ribs 40 can be raised to a first elevation 132. The term "first elevation 132" can refer broadly to the general positioning of the second ends 44 of the canopy support frame 14 when the canopy support frame 14 is in the open position 62.

With regard to the first elevation 132, where the canopy support frame 14 is configured in a uniform fashion, each of the second ends 44 of the first plurality of ribs 40 can be raised to substantially the same elevation or height. However, in another embodiment, which has been described above, the canopy support frame 14 can be configured in a non-uniform fashion, wherein the second ends 44 of the respective ones of the up members 120 and the down members 130 can be positioned at different heights. In this regard, although the second ends 44 of the up members 120 and the down members 130 may be positioned at different heights when the canopy support frame 14 is in the open position 62, each of these second ends 44 can be considered to be at the first elevation 132. Additional description and comparison will be provided below with regard to the extended position 64 of the canopy support frame 14.

With reference now to the side plan view of FIG. 4, the umbrella 10 is illustrated as being in the extended position 64. As shown therein, each of the second ends 44 of the first plurality of ribs 40 can be positioned at a second elevation 134. The term "second elevation 134" can refer broadly to the general positioning of the second ends 44 of the canopy support frame 14 when the canopy support frame 14 is in the extended position 64. According to one implementation of the present invention, the second ends 44 of the first plurality of ribs 40 can be positioned at approximately the same height when in the extended position 64. Further, the first plurality of ribs 40 can collectively define a common plane when in the extended position 64.

Similar to the first elevation 132, the second elevation 134 is not limited to a configuration wherein each of the second ends 44 are at exactly the same height. However, when in the extended position 64, each of the second ends 44 can preferably be at approximately the same height at the second elevation 134. Nevertheless, other configurations are contemplated, wherein the second ends of the first plurality of ribs 40 can be positioned at substantially different heights when positioned at the second elevation 134. Such a concept is similar to that discussed above with respect to the first elevation 132.

According to an aspect of the present invention, it is contemplated that the second elevation 134 can be generally higher than the first elevation 132. Thus, when the canopy support frame 14 moves from the open position 62 to the extended position 64, at least one of the second ends 44 of the canopy support frame 14 should be raised from the first elevation 132 to the second elevation 134. Preferably, each of the second ends 44 can be moved from the first elevation 132 upwardly to the second elevation 134 when the canopy support frame 14 moves from the open position 62 to the extended position 64.

Referring still to FIG. 4, it is contemplated that the canopy support frame 14 can further comprise at least one support strut 140. The support strut can define a first end 142 and a second end 144. The first end 142 of the support strut 140 can be coupled to the intermediate hub 34, as illustrated in FIG. 4. The second end 144 of the support strut 140 can be coupled to one of the second plurality of ribs 50. FIG. 4 is an exemplary illustration wherein two support struts 140 can operatively interconnect two of the second plurality of ribs 50 with the intermediate hub 34.

Additional configurations can be provided, wherein more than two support struts 140, such as four or six, can be used in the canopy support frame 14. Thus, more than two of the second plurality of ribs 50 can be interconnected to the intermediate hub 34. In this regard, the combination of one of the second plurality of ribs 50 with one of the support struts 140 can be collectively referred to as a strut pair 150.

As illustrated in FIG. 4, it is contemplated that the second hub 32 can comprise at least a first runner 152 and a second runner 154, in what was previously referred to as a "split" or "nested" second hub 32. According to an implementation of the present invention, the first and second runners 152, 154 can each be coupled to at least one of the second plurality of ribs 50 at the first ends 54 thereof. As mentioned above, although it is contemplated that the second plurality of ribs 50 can be coupled to a common second hub 32, the first and second runners 152, 154 can be provided such that selected ones 156 of the second plurality of ribs 50 are coupled to the first runner 152 and remaining ones 160 of the second plurality of ribs 50 are coupled to the second runner 154. The selected ones 156 can be those of the second plurality of ribs 50 that are not coupled to the second runner 154, and are shown in hidden lines in FIG. 4.

In FIG. 4, an embodiment is illustrated wherein two remaining ones 160 of the second plurality of ribs 50 are coupled to the second runner 154. As illustrated in FIG. 4, the two remaining ones 160 can each respectively be part of the illustrated strut pairs 150 coupled to the second runner 154, the intermediate hub 34, and a respective one of the first plurality of ribs 40. Such a configuration can be repeated for additional strut pairs 150. Thus, as shown in FIG. 4, at least two strut pairs can be operatively connected in such a manner.

FIG. 4 also illustrates that the first runner 152 can be coupled to the remaining ones 160 of the second plurality of ribs 50. With reference to FIG. 4 and to FIG. 3, it is contemplated that the selected ones 160 of the second plurality of ribs 50 can be respectively coupled to the up members 120 and the down members 130. Various other configurations can be implemented utilizing the teachings herein.

With reference now to FIGS. 2 and 3, it is contemplated that the first actuating handle 70 can be moved from a first position 166 to a second position 168 in order to move the canopy support frame from the closed position 60 to the open position 62. Referring now to FIGS. 3 and 4, it is contemplated that the second actuating handle 72 can be moved from a first position 170 to a second position 172 in order to move the canopy support frame 14 from the open position 62 to the extended position 64, respectively. In this regard, it is contemplated that the first positions 166, 170 of the respective ones of the first and second actuating handles 70, 72 can be higher than the second positions 168, 172, respectively. Thus, the first and second actuating handles 70, 72 can be vertically translatable along the lower pole 16 and can be at least partially disposed within the respective ones of the first and second elongate channels 20, 74, according to an implementation of the present invention.

Referring now to FIG. 5, an exemplary cross-section of the lower pole 16, as called out in FIG. 2, is illustrated. As mentioned previously, the lower pole 16 can define a substantially circular cross-sectional periphery. Further, the first and second elongate channels 20, 74, can be at least partially recessed in the outer surface 22 of the lower pole 16. The first and second elongate channels 20, 74 can define substantially rectangular cross-sections that can be sized and configured to retain at least a portion of the respective ones of the first and second actuating handles 70, 72 there within while permitting the first and second actuating handles 70, 72 to be translatable there within.

The position of the cross-section illustrated in FIG. 5, as called out in FIG. 2, is adjacent the top end 112 of the lower pole 16. Therefore, the cross-sectional illustration of FIG. 5 further illustrates a cross-section of the first elongate member 80, which can be sized and configured to be translatable within the first elongate channel 20. Further, FIG. 5 also illustrates a cross-section of the upper pole 18 that can be disposed within the central passage 90 of the lower pole 16. As shown, the upper pole 18 can have a substantially rectangular cross-section. Nevertheless, the configurations and sizes of the elements shown in the embodiment of FIG. 5 can be variously modified and can further include additional features that compliment and/or facilitate the implementation of such an embodiment of the present invention.

Figure 6:
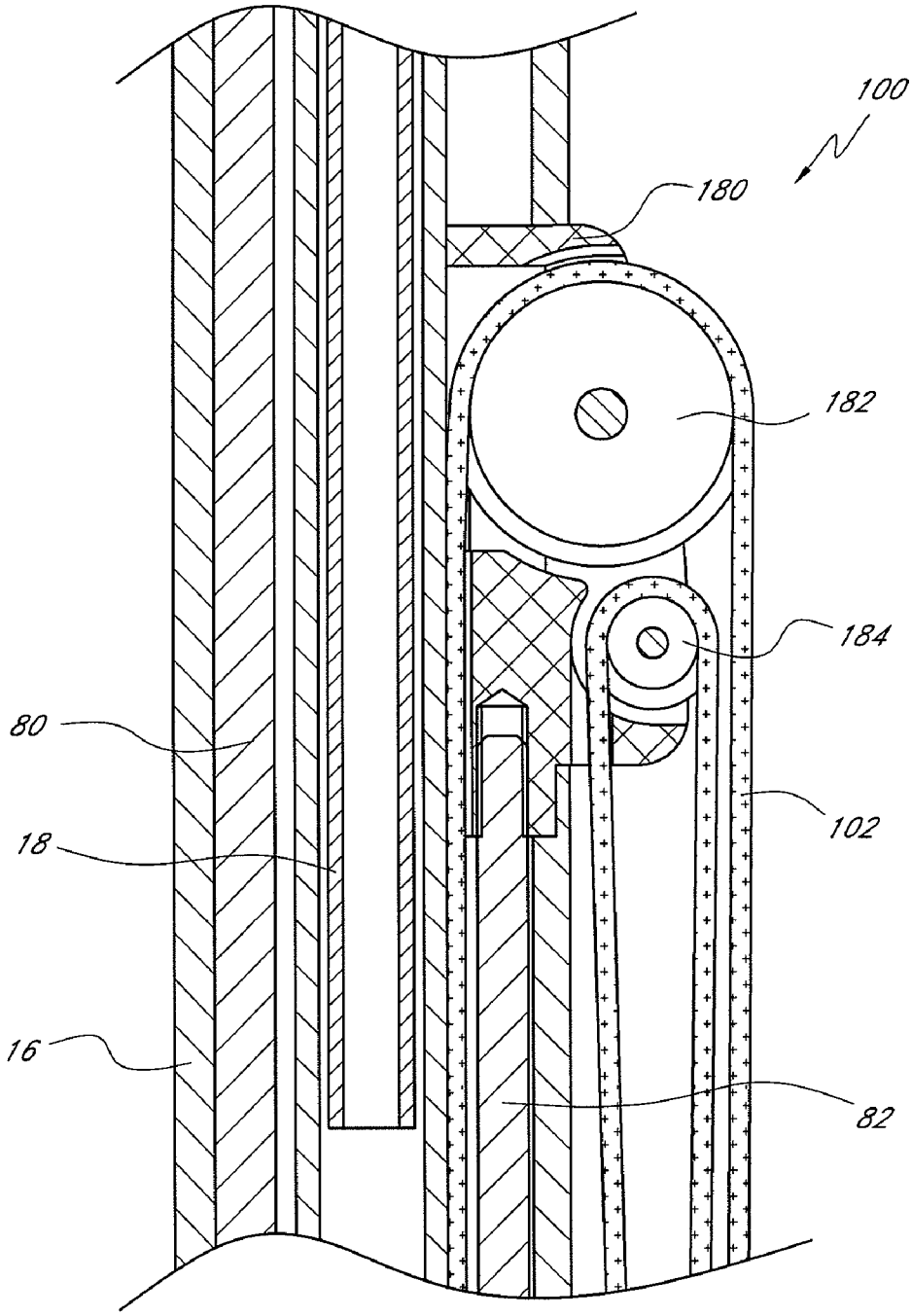
FIG. 6 is a cross-sectional view of the umbrella shown in FIG. 2, partly broken away.

Referring now to FIG. 6, a cross-section of the umbrella 10, as called out in FIG. 2, is provided. FIG. 6 illustrates an exemplary configuration of the pulley assembly 100. As shown, the pulley assembly 100 can include a pulley block 180 and at least a first roller 182. In the embodiment illustrated in FIG. 6, the pulley assembly 100 can further include a second roller 184. The first and second rollers 182, 184 can be rotatably coupled to the pulley block 180. Further, the pulley block 180 can be sized and configured such that the tension member 102 can be introduced therethrough and disposed onto the first and second rollers 182, 184.

As shown in FIGS. 2 and 6, in an exemplary embodiment, the first end 104 of the tension member 102 can be coupled to the second actuating handle 72. The tension member 102 can then extend upwardly from the second actuating handle 72 toward the pulley assembly 100. As shown in FIG. 6, the tension member 102 can then engage the first roller 182 and extend downwardly toward the second hub 32. The tension member 102 can then engage a third roller (not shown) that is rotatably coupled to the second hub 32 (such as on the first runner 152) and then extend upwardly again toward the pulley assembly 100. Finally, the tension member can then engage the second roller 184 and extend downwardly toward the second hub 32, where the second end 106 of the tension member 102 can be coupled. Thus, in such a configuration, with the pulley assembly 100 being fixed relative to the second runner 154 of the second hub 32, the first runner 152 can be vertically translated along the lower pole 16 upon vertical translation of the second actuating handle 72.

According to another aspect of the present invention, the pulley assembly 100 can be sized and configured to be vertically translatable along the lower pole 16. In this regard, it is contemplated that the second elongate channel 74, or another channel similarly disposed, can be disposed along the lower pole 16 at least intermediate the second hub 32 and the intermediate hub 34, such that the pulley assembly 100 can be vertically translatable along the channel. In such a configuration, as described below, the second runner 154 and the pulley assembly 100 can both move along the lower pole 16 in response to the movement of the first actuating handle 70. In some embodiments, the second runner 154 and the pulley assembly 100 can move together along the lower pole 16. For example, the space between the second runner 154 and pulley assembly 100 can remain constant as the translation occurs. FIG. 6 illustrates an exemplary spacing and configuration of the first elongate member 80, the upper pole 18, and the second elongate member 82.

Figure 7:
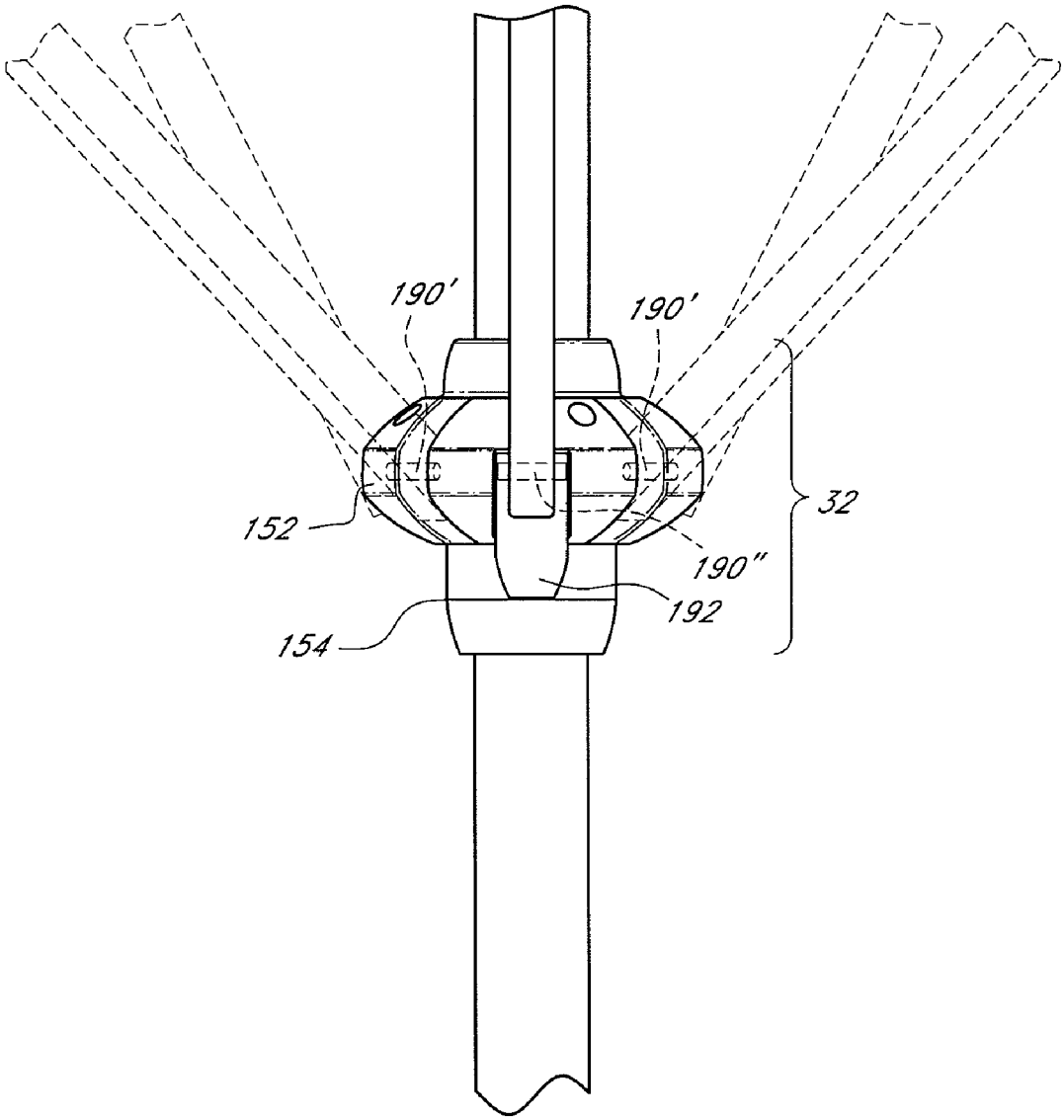
FIG. 7 is a plan view of the umbrella shown in FIG. 1, showing detail around the lower hub thereof.

Referring now to FIG. 7, it is contemplated that the second hub 32 can be configured such that the first and second hub components or runners 152, 154 can be nested. As shown in FIG. 7, a plurality of coupling pins can be used to couple the second plurality of ribs 50 to the second hub 32. Preferably, when in a nested position, the coupling pins 190' of the first hub component or runner 152 can be disposed at substantially the same height as the coupling pins 190" of the second hub component or runner 154. In this regard, as shown in FIG. 7, the second hub component or runner 154 can be configured to include a pair of opposing shoulders 192 whereat the respective ones of the second plurality of ribs 50 can be coupled to the second hub component or runner 154. The shoulders 192 preferably can be sized and configured with the coupling pins 190" disposed therein being at substantially the same height as the coupling pins 190' of the first runner 152 when the second hub 32 is in the nested position. The first and second runners 152, 154 can be variously configured and modified utilizing the teachings herein.

In accordance with yet another aspect of the present invention, it is contemplated that the first and second actuating handles 70, 72 can further define an engagement surface and include a tightening element that allows the engagement surfaces of the first and second actuating handles 70, 72 to frictionally engage the lower pole 16. For example, the tightening element can be a clamp or screw that allows the first and second actuating handles 70, 72 to clamp onto the outer surface 22 of the lower pole 16, such as onto a ridge formed by the first and second elongate channels 20, 74.

Additionally, the tightening element can cause the first and second actuating handles 70, 72 to expand within the first and second elongate channels 20, 74 to thereby frictionally engage the lower pole 16. Thus, the first and second actuating handles 70, 72 can be positioned in a fixed position relative to the lower pole 16. Using this feature, once the umbrella 10 has moved to the open position 62 and the extended position 64, the frictional engagement of the first and second actuating handles 70, 72 can maintained the position of the first and second actuating handles 70, 72 at the respective second positions 168, 172.

As discussed above with respect to FIGS. 4 and 7, the second hub 32 can comprise at least the first hub component or runner 152 and the second hub component or runner 154. As such, the second hub 32 can be referred to as a "split" or "nested" hub. As shown in a bottom perspective view of FIG. 8, the second hub 32 is "split" in that it comprises more than one component, and is "nested" in that at least a portion of the second runner 154 can be fitted to within a cavity or recess of the first runner 152. Alternatively, the second hub 32 can be configured such that the first runner 152 fits to within a recess of second runner 154. Further, the first and second hub components or runners 152, 154 can each include cavities or recesses into which certain portions of the other respective runners 152, 154 can be received.

This type of fitting between the first and second runners 152, 154 can have several aesthetic and mechanical advantages. For example, not only will the first and second runners 152, 154 create a streamlined and integrated appearance, but the integrated fit of some embodiments can tend to create greater structural rigidity of the umbrella rib structure.

Figure 8:
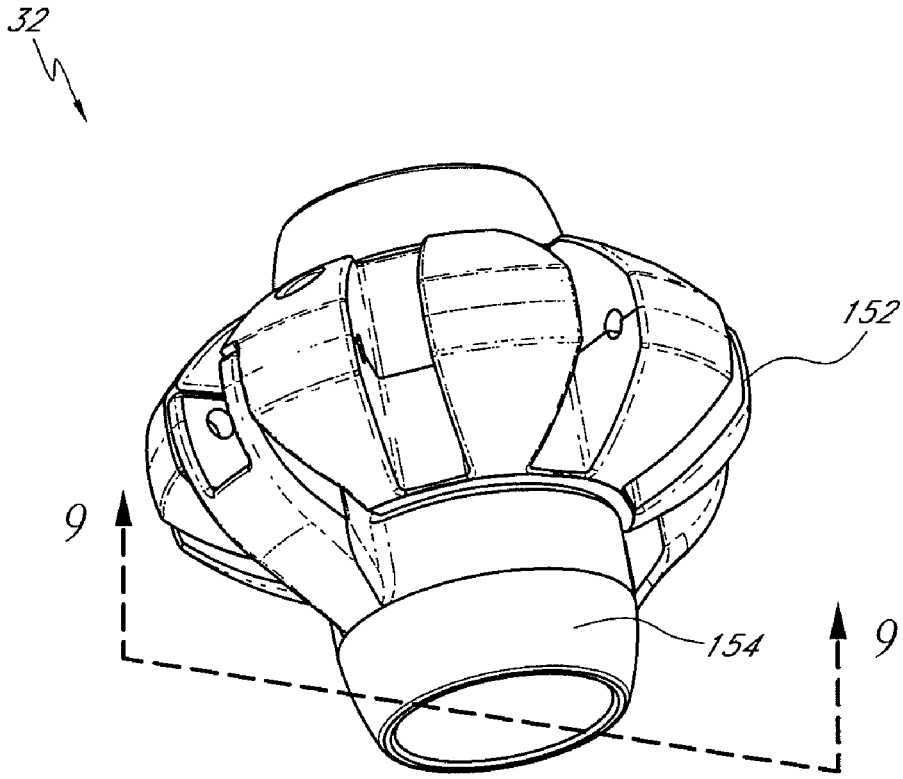
FIG. 8 is a bottom perspective view of a second hub illustrating a nested arrangement of first and second hub components or runners of the hub, in accordance with an embodiment.
Figure 9:
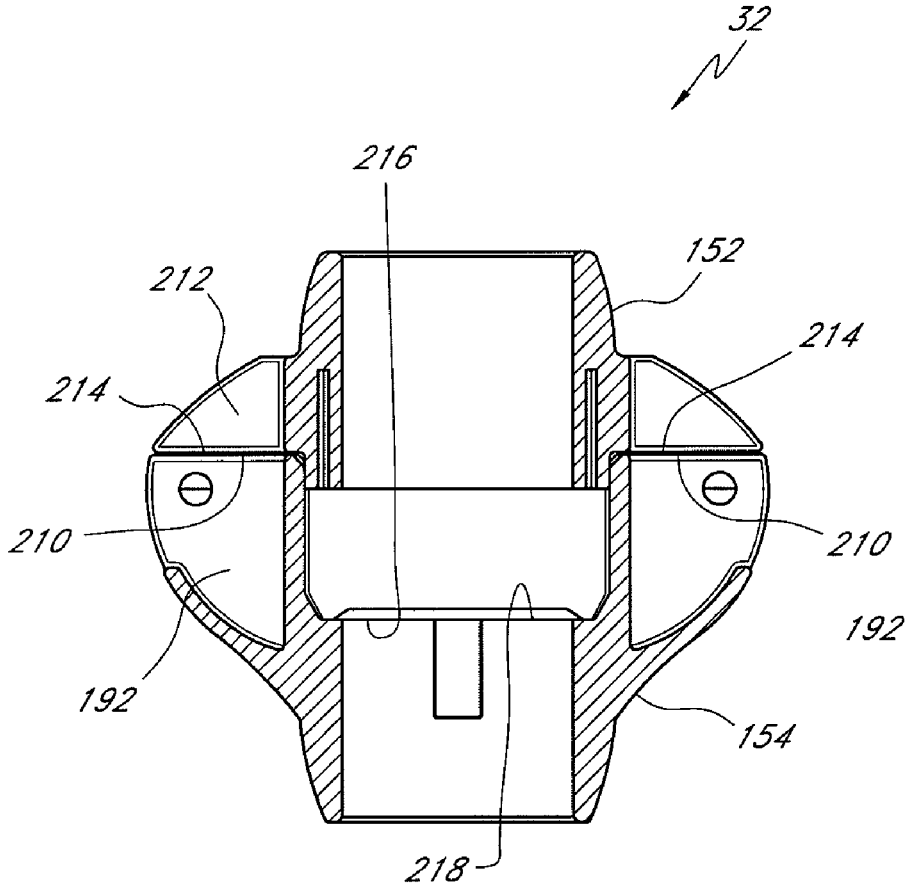
FIG. 9 is a side cross-sectional view of the hub shown in FIG. 8.

Referring now to FIG. 9, a side cross-sectional view of the second hub 32 of FIG. 8 is shown. As illustrated therein, the second runner 154 can include a pair of opposing shoulders 192, which can be diametrically opposed on the second runner 154. The opposing shoulders 192 can be received to within a nesting cavity 210 of the first runner 152. Accordingly, the first runner 152 can include a corresponding number of nesting cavities 210 such as required by the configuration of the second runner 154. The nesting cavities 210 and the opposing shoulders 192 can be configured to provide a very close fit when the second runner 154 is nested with the first runner 152.

Although sides of the nesting cavity 210 and opposing shoulders 192 are illustrated in the embodiment of FIG. 9 as being straight, it is contemplated that other interlocking features can be present in the configurations of the nesting cavity 210 and the shoulders 192. Further, as shown in FIG. 9, the first runner 152 can include opposing abutments 212 that can be configured to abut top surfaces 214 of the opposing shoulders 192. In some embodiments, the top surfaces 214 of the opposing shoulders 192 can be configured to include features that mate with corresponding features of the opposing abutments 212. Other various modifications can be implemented in order to facilitate interconnection and stability of the second hub 32.

In accordance with some embodiments, the second runner 154 and the first runner 152 can include corresponding surfaces that mate in order to facilitate nesting of the first and second hub components or runners 152, 154 with each other. These structures can maintain a generally fixed orientation of the second runner 154 with respect to the first runner 152 when in the nested position. For example, as discussed above, the top surface 214 of the second runner 154 can mate with the opposing abutment 212 when the opposing shoulders 192 are received to within the nesting cavities 210.

In other embodiments, the nesting cavities 210 can be configured with a depth corresponding to a height of the opposing shoulders 192. Accordingly, the top surface 214 can mate with the abutment 212 and a lower surface 216 of the first runner 152 can abut an upper surface 218 of the second runner 154 when the first and second hub components or runners 152, 154 are in the nested position.

In such embodiments, the first and second runners 152, 154 can be configured to allow vertical forces to be evenly distributed intermediate the first and second hub components or runners 152, 154. As such, some embodiments can therefore provide that when the second runner 154 is in a fixed position along the pole of the umbrella, the weight or downward force exerted by the first runner 152 can be evenly born along the upper surface 218 and the top surface 214 of the second runner 154 rather than creating point loads at discrete locations on the second runner 154. Failure and warpage of the components of the umbrella can thereby be mitigated and/or prevented.

Figure 10A:
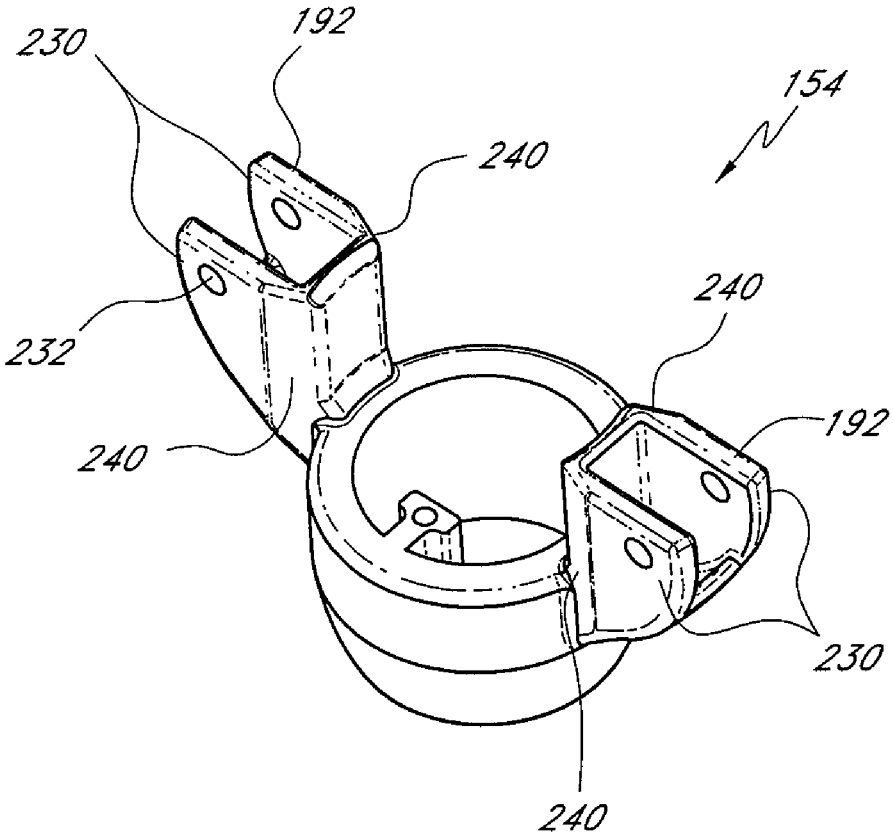
FIG. 10A is a top perspective view of the second hub component or runner of the hub shown in FIG. 8.
Figure 10B:
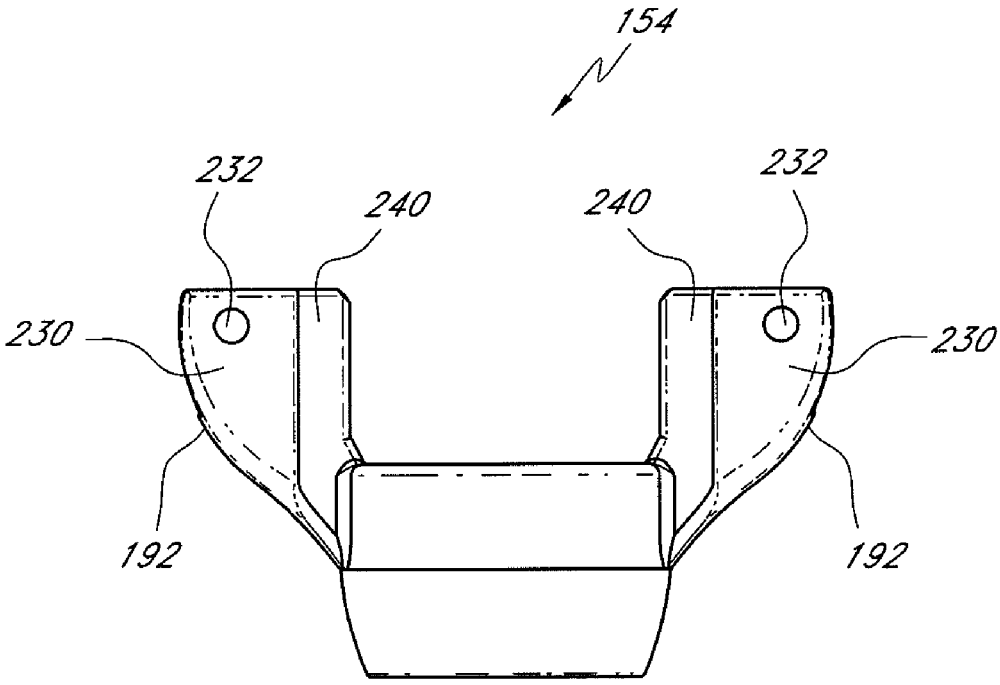
FIG. 10B is a side view of the second hub component or runner shown in FIG. 10A.
Figure 10C:
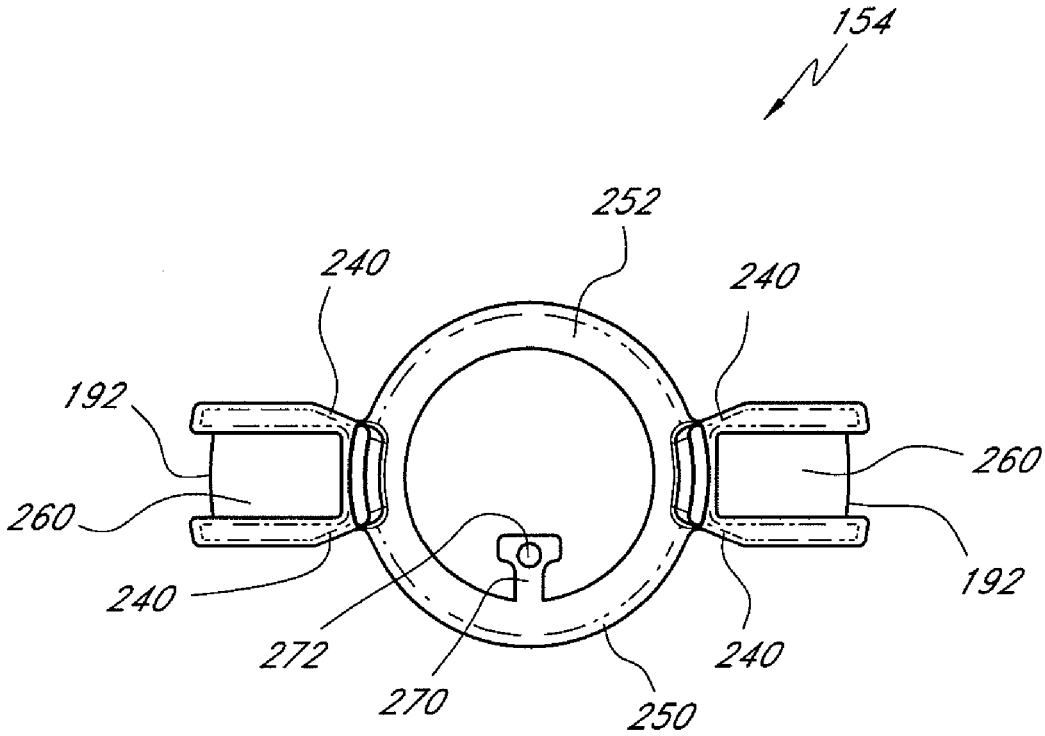
FIG. 10C is a top view of the second hub component or runner shown in FIG. 10A.

FIGS. 10A-C illustrate an exemplary embodiment of the second runner 154. As shown in the perspective view of FIG. 10A, the opposing shoulders 192 can be configured to include a pair of vertical side walls 230. Each of the opposing side walls can include an aperture 232 configured to receive a pin in order to interconnect an umbrella rib with one of the opposing shoulders 192. Although the embodiment illustrated in FIGS. 10A-B shows the apertures 232 disposed along an upper area of the opposing side walls 230, the apertures 232 can be disposed at any appropriate location based on the configuration of the opposing shoulders 192.

In some embodiments, the opposing shoulders can also include tapered sections 240. As discussed above, the tapered sections can represent a feature of the opposing shoulders 192 that can assist in maintaining a generally fixed orientation of the second runner 154 relative to the first runner 152 when in the nested position. The tapered sections 240, as noted further below, can mate with a corresponding structure of the first runner 152. As shown in FIG. 10B, the tapered sections can extend generally vertically along an interior area of the opposing shoulders 192. As shown in FIG. 10C, in some embodiments, the tapered sections 240 can be generally flat and can extend generally perpendicularly from a perimeter 250 of a center 252 of the second runner 154.

In accordance with other embodiments, the opposing shoulders 192 can include recesses 260 for accommodating distal ends of the ribs connected thereto. The recesses 260 preferably correspond to the width of the ribs received therein. Furthermore, the recesses 260 should further be configured to allow the distal end of the rib to pivot with respect to the pin. It is also contemplated that embodiments can be provided wherein the distal ends of the rib can be shaped as fork members whereinto the opposing shoulders 192 can be pivotably coupled.

Furthermore, as shown in FIG. 10C, the second runner 154 can also include a guide 270 for coupling the second runner 154 to the pole of the umbrella. In some embodiments, the guide 270 can be used to generally fix at least one of the vertical or rotational orientations of the second runner 154 relative to the pole. For example, as discussed above, some embodiments of the umbrella can be configured such that the second runner 154 is fixed relative to the pole. Alternatively, the guide 270 could be used to effectuate movement of the second runner 154 therealong.

As shown in the embodiment of FIG. 10C, the guide 270 can be configured as a T-shaped member and can optionally include a connection aperture 272. The connection aperture 272 can be configured to receive a screw, bolt, a vertical rod, or other structure to secure the guide 270 to within the pole of the umbrella. As such, depending on the configuration of the pole, which may include a longitudinal slot or an aperture through which the guide 270 can be received, and further depending on whether the second runner 154 is fixed, the attachment means can fix the longitudinal position and/or the rotational position of the second runner 154 relative to the pole.

Figure 11A:
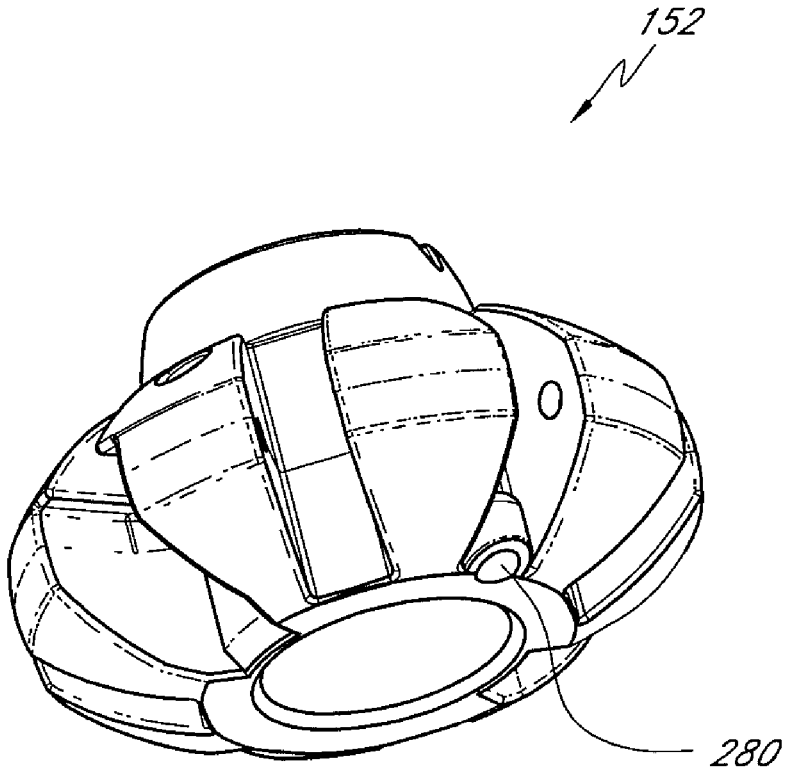
FIG. 11A is a top perspective view of the first hub component or runner of the hub shown in FIG. 8.
Figure 11B:
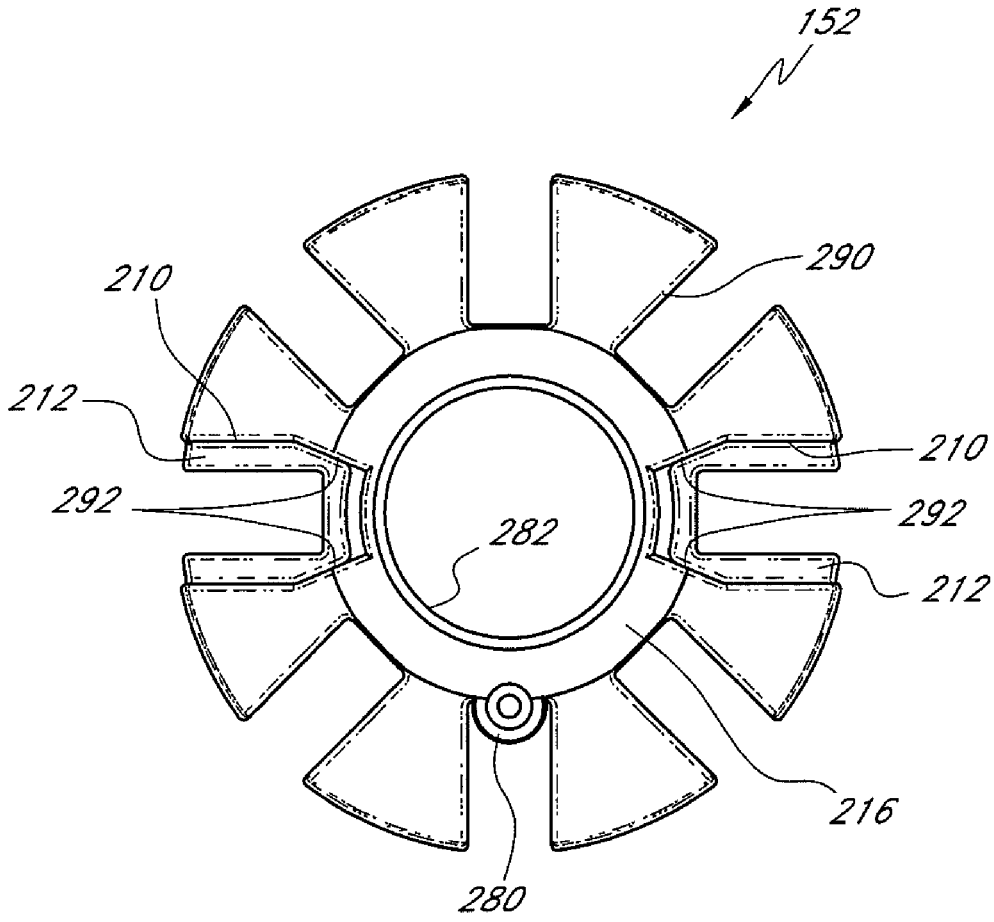
FIG. 11B is a top view of the first hub component or runner shown in FIG. 11A.

Referring now to FIGS. 11A-B, an exemplary embodiment of the first runner 152, as illustrated in FIG. 8, is shown. The first runner 152 can include a coupling aperture 280. The coupling aperture 280 can be disposed adjacent the inner perimeter of the first runner 152. As such, as described above, when the first runner 152 slides relative to the pole, the coupling aperture 280 can be used to receive a guide pole or rod that can be used to maintain the relative axial orientation of the first runner 152 relative to that of the pole to maintain the relative axial or rotational orientation substantially constant relative to that of the pole. However, in other embodiments, it is contemplated that the inner perimeter 282 can include a guide such as that illustrated with respect to the second runner 154 or other means in order to maintain the structural rigidity and alignment of the first runner relative to the pole.

As shown best in FIG. 11B, the bottom view of the first runner 152 illustrates that the nesting cavity 210 can tend to be larger than rib connection cavities 290 in order to accommodate the size of the opposing shoulders 192. Further, the nesting cavities 210 can also include tapered sections 292 configured and corresponding to the tapered sections 240 of the second runner 154. Further, as discussed above, with respect to FIG. 9, the opposing abutments 212 and the lower surface 216 preferably include a sufficient surface area to mate with the respective ones of the top surfaces 214 and the upper surface 218 of the second runner 154. In such embodiments, the configuration of the opposing abutments 212, the opposing shoulders 192, and the general configuration of the top and bottom mating areas of the first and second runners 152, 154 can tend to reduce stress concentrations in any portion of the first and second runners 152, 154.

Now, according to a first embodiment and operation of embodiments discussed herein, the umbrella 10 can be configured to include only the first actuating handle 70. The first actuating handle 70, as taught herein, can be utilized to move the canopy support frame 14 from the closed position 60 to the open position 62. In such an embodiment, the first actuating handle 70 can be vertically translatable along the first elongate channel 20, and in response to the vertical translation of the first actuating handle 70, at least the first hub 30 can experience a corresponding vertical translation in order to move the canopy support frame 14 from the closed position 60 to the open position 62.

According to a second embodiment and operation of the present invention, the umbrella 10 can include both the first and second actuating handles 70, 72. In such an embodiment, vertical displacement of the first actuating handle 70 can cause a corresponding vertical translation of the first hub 30 to move the canopy support frame 14 from a closed position 60 to an open position 62. Further, vertical translation of the second actuating handle 72 can cause a corresponding vertical translation of the second hub 32 in order to move the canopy support frame 14 from the open position 62 to the extended position 64. The first and second actuating handles 70, 72 can travel along the lower pole 16 and be at least partially disposed within the respective ones of the first and second elongate channels 20, 74.

According to a third and preferred embodiment and operation, the umbrella 10 can comprise the first and second actuating handles 70, 72. As with the second embodiment, vertical translation of the first and second actuating handles 70, 72 can cause corresponding vertical translation of the respective ones of the first and second hubs 30, 32. However, in the third and preferred embodiment, the second hub 32 can comprise the first and second runners 152, 154. Thus, vertical translation of the second actuating handle 72 can cause relative movement between the first and second runners 152, 154. For example, the first runner 152 can rise at a faster rate than the second runner 154 during movement of the second hub 32.

The third and preferred embodiment can also include the first and second elongate members 80, 82. As mentioned above, the first elongate member 80 can be coupled to the first hub 30 and the first actuating handle 70 in order to ensure that the position of the first hub 30 is fixed relative to the position of the first actuating handle 70. Thus, downward vertical translation of the first actuating handle 70 can directly result in corresponding downward vertical translation of the first hub 30. Such exemplary movement can be made when moving the canopy support frame 14 from the closed position 60 to the open position 62.

In accordance with another aspect of the third and preferred embodiment, the second elongate member 82 can be coupled to the pulley assembly and the second hub 32. It is contemplated that the lower end 110 of the second elongate member 82 can be coupled to either the first or second runners 152, 154 of the second hub 32. However, in the third and preferred embodiment, the second elongate member 82 can be coupled with the second runner 154. Thus, the position of the pulley assembly 100 can be fixed relative to the position of the second runner 154, and allow the first runner 152 to be vertically translated along the lower pole 16 upon vertical translation of the second actuating handle 72.

Furthermore, the third and preferred embodiment can also include two strut pairs 150 which can be coupled to the second runner 154, the intermediate hub 34, and respective ones of the first plurality of ribs 40. When the first actuating handle 70 is downwardly vertically translated, the first hub 30 can be correspondingly downwardly vertically translated which can result in the expansion of the canopy support frame 14 from the closed position 60 toward the open position 62. During this expansion, the first ends 42, 54 of the first and second pluralities of ribs 40, 50 can be moved towards each other (with the second ends 44, 54 thereof moving radially outwardly) due to the coupling of the strut pair 150 with the intermediate hub 34, which can be fixedly mounted to the lower pole 16. Thus, the first hub 30 and the second hub 32 can tend to relatively converge toward each other during the movement of the canopy support frame 14 from the closed position 60 to the open position 62. Additionally, during this expansion, the position of the pulley assembly 100 can be fixed relative to the position of the second hub 32. Thus, the upward vertical translation of the second hub 32 can be at least partially limited by the size of the second elongate member 82 which can interconnect the pulley assembly 100 and the second hub 32 and the distance between the pulley assembly 100 and the intermediate hub 34. In operation, the open position 62 can be achieved once the pulley assembly 100 has been moved to a position adjacent to or just lower than the intermediate hub 34.

In the third embodiment, when the canopy support frame 14 has reached the open position 62, the second actuating handle 72 can be downwardly vertically translated in order to draw the tension member 102 through the pulley to thereby raise the first runner 152 from the nested position of the second hub 32. This movement of the first runner 152 can cause a corresponding movement of the remaining ones 160 of the second plurality of ribs 50. Such movement can cause the first plurality of ribs 40 has to be raised to the extended position 64. Finally, the first and second actuating handles 70, 72 can be fixed in position relative to the lower pole 16 using the tightening elements.

Figure 12:
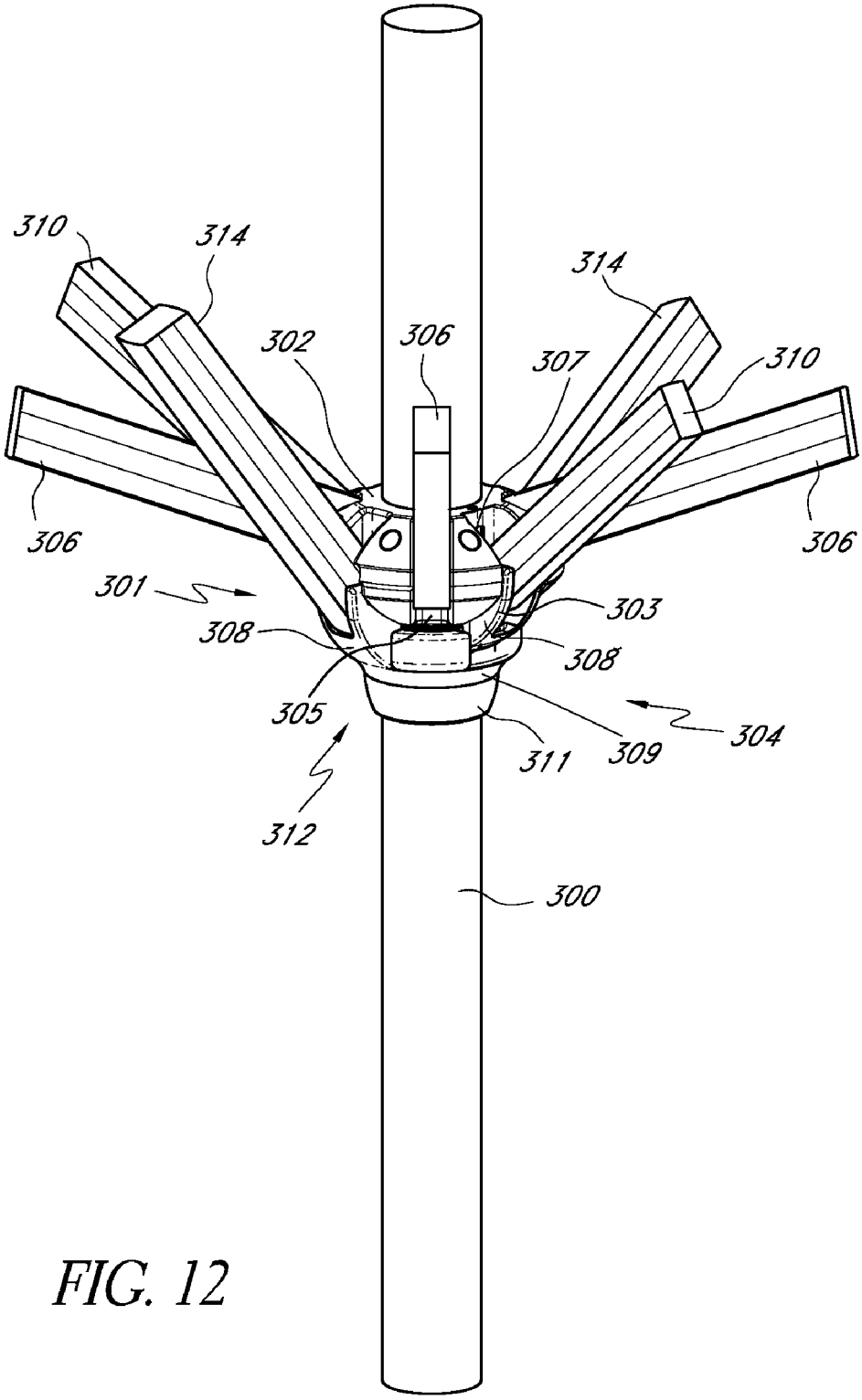
FIG. 12 is a partial side view of an umbrella according to the invention, showing an umbrella pole carrying a nested hub having three hub components carrying a plurality of ribs.

Referring now to FIG. 12, there is illustrated therein an embodiment of the invention comprising an umbrella pole 300 carrying a nested hub 301, which comprises an upper hub component 302, an intermediate hub component 303 and a lower hub component 304. As can be seen in this figure and other figures illustrating nested hubs in accordance with the present invention, the overall external shape of the nested hub and the shapes of the hub component are such as to generate a nested hub having external shape generally similar to that of a single hub.

Upper hub component 302 can be regarded as a master hub and comprises a plurality of recesses 305 in which are hingably mounted ribs 306. Hub component 302 comprises further generally radially extending recesses 307 for receiving projection or yoke like element 308 of the other two hub components. Each yoke-like projection 308 carries a rib hingably mounted therein. Accordingly, as shown in FIG. 12, intermediate hub component 303 comprises a collar 309 slidably mounted on pole 300 and bearing yoke-like elements 308. Hingably mounted in the yoke-like element 308 of intermediate hub component 303 are ribs 310.

Figure 13:
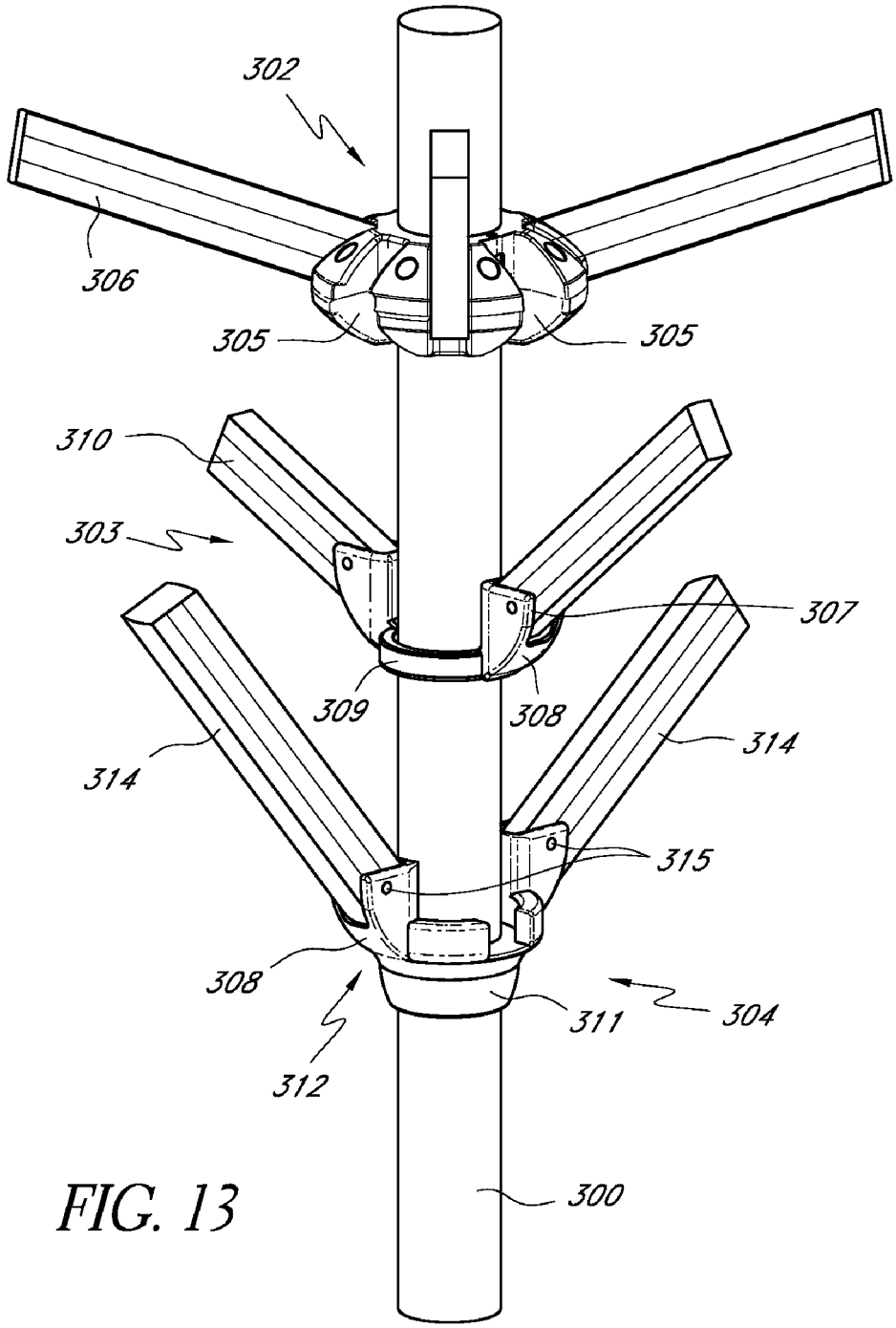
FIG. 13 is a side plan view of the hub shown in FIG. 12 and in which the three hub components have been separated from one another.

Lower hub component 304 similarly comprises a collar 311 slidably mounted to pole 300 and comprising a housing 312 having a cavity 313, as it may be more clearly seen in FIG. 13, for receiving the collar 309 of the intermediate hub component and shaped so that the intermediate hub component will nestle snuggly therein. Yoke-like components 308 of lower hub component 304 hingably carry ribs 314 about pivot points 315, as shown in FIG. 13. The ribs in FIGS. 12 and 13 can be similarly mounted.

The yoke components 308 and the recesses in which they nest may be varied in shape and size, but are typically similar to those described in connection with FIGS. 8 to 11*b* above.

As can be seen in FIGS. 12 and 13, upper hub component 302 carries four ribs 306, intermediate hub 303 carries two ribs 310 and lower hub component 304 carries two ribs 314.

Figure 14:
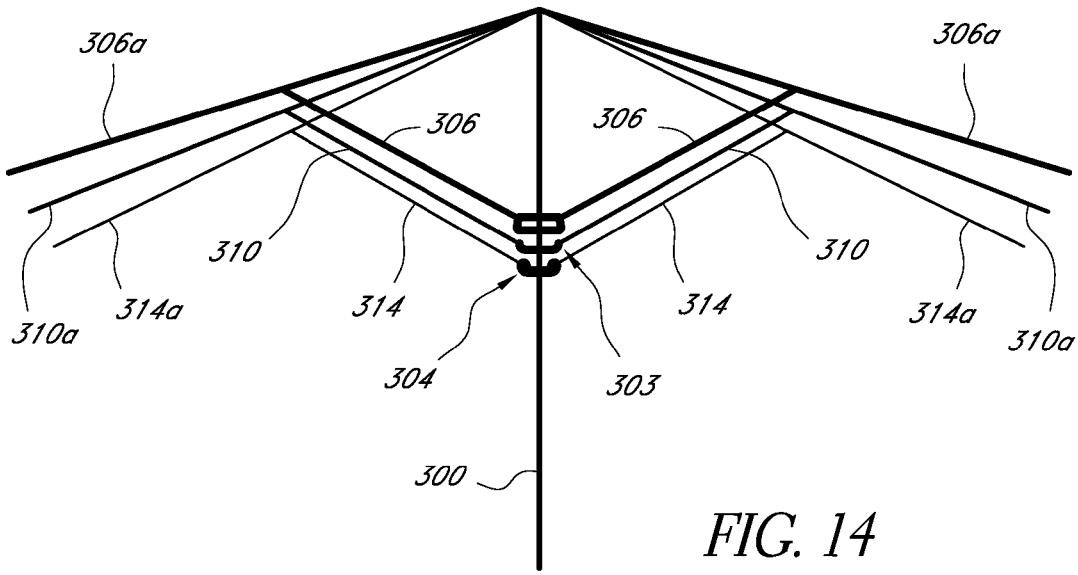
FIG. 14 is a schematic view of an umbrella incorporating the hub component shown in FIGS. 12 and 13.
Figure 15:
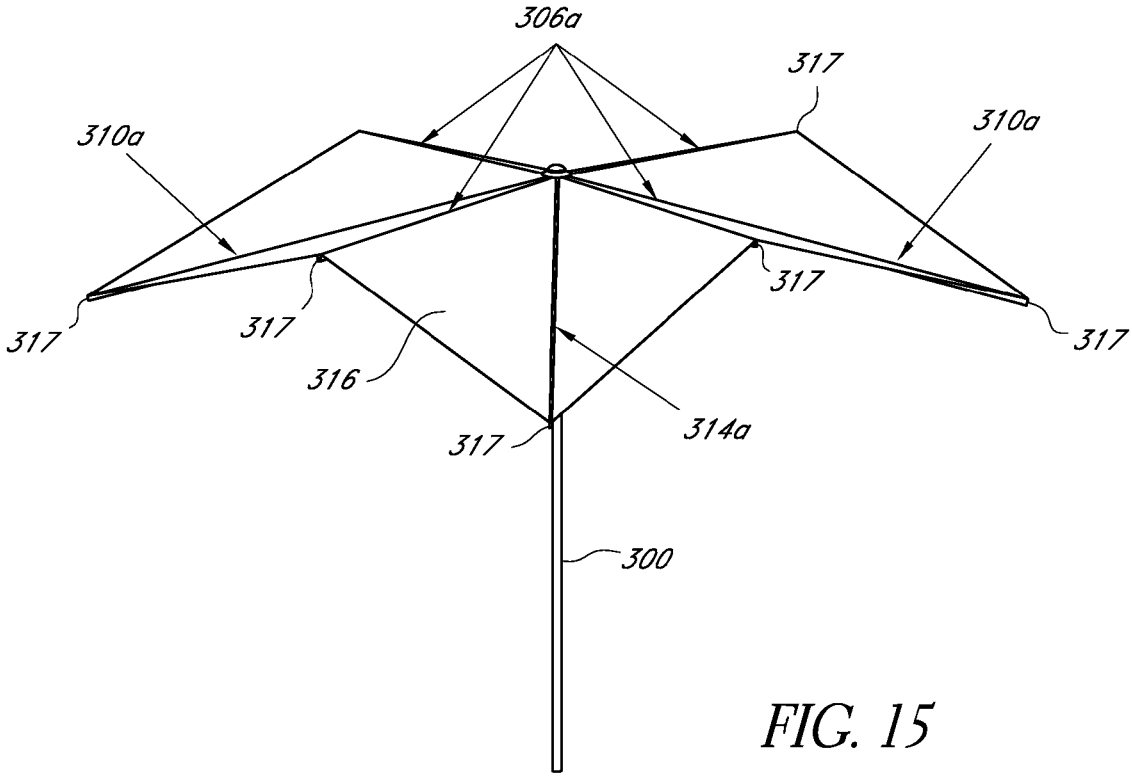
FIG. 15 is a schematic view of an umbrella, showing the effect of the hub arrangements in FIGS. 12 to 14 on the shape of the umbrella canopy.

Turning now to FIGS. 14 and 15, there is shown therein a schematic illustration of umbrellas according to the invention incorporating the nested hub according to the embodiment shown in FIGS. 12 and 13. Like reference numerals in FIGS. 14 and 15 as to those used in FIGS. 12 and 13 refer to similar elements.

FIG. 14 shows ribs 306*a*, 310*a* and 314*a* that carry a canopy schematically illustrated in FIG. 15 as 316. These canopy ribs are associated respectively with the ribs 306 of hub component 302; the ribs 310 of hub component 303 and the ribs 314 of hub component 304. Thus, it is apparent that each hub component via its ribs is connected to its own set of canopy ribs.

In use, the umbrella is typically opened by a first mechanism, such as the track mechanism illustrated in FIGS. 1 to 6 or by a cord and pulley arrangement to a position shown in FIG. 14 where the associated canopy ribs 306*a* are opened or deployed. Preferably, those ribs remain in that position while the additional hub components are deployed. Thus, for example, activating the intermediate hub component 303 lowers the connected ribs 310 from their original open or deployed position. Further, activating lower hub component 304 further pulls down the position of ribs 314*a*. As a consequence, the umbrella has the general shape illustrated in FIG. 15 in which the tips 317 of the canopy ribs are located at three different positions above the ground. This results in an umbrella profile in which the canopy has a serrated or zig-zag pattern.

Another embodiment of the invention is shown in FIGS. 16 and 17 where again like numerals refer to like elements and in which the master hub 400 is now located in the intermediate hub position between upper hub component 401 and lower hub component 402.

Figure 16:
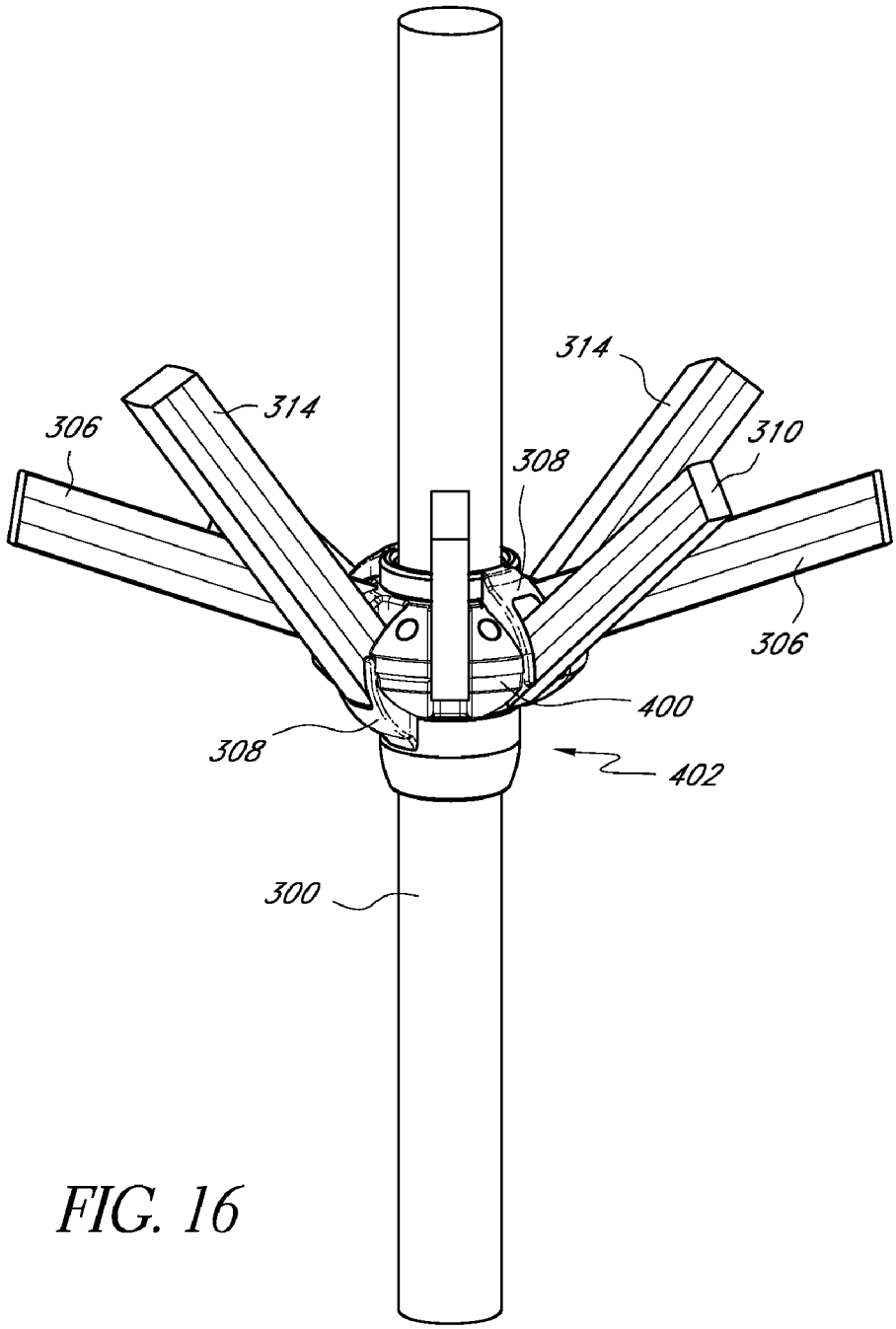
FIG. 16 is a partial view of an umbrella according to the invention, showing a hub having three hub components, each carrying a plurality of ribs.
Figure 17:
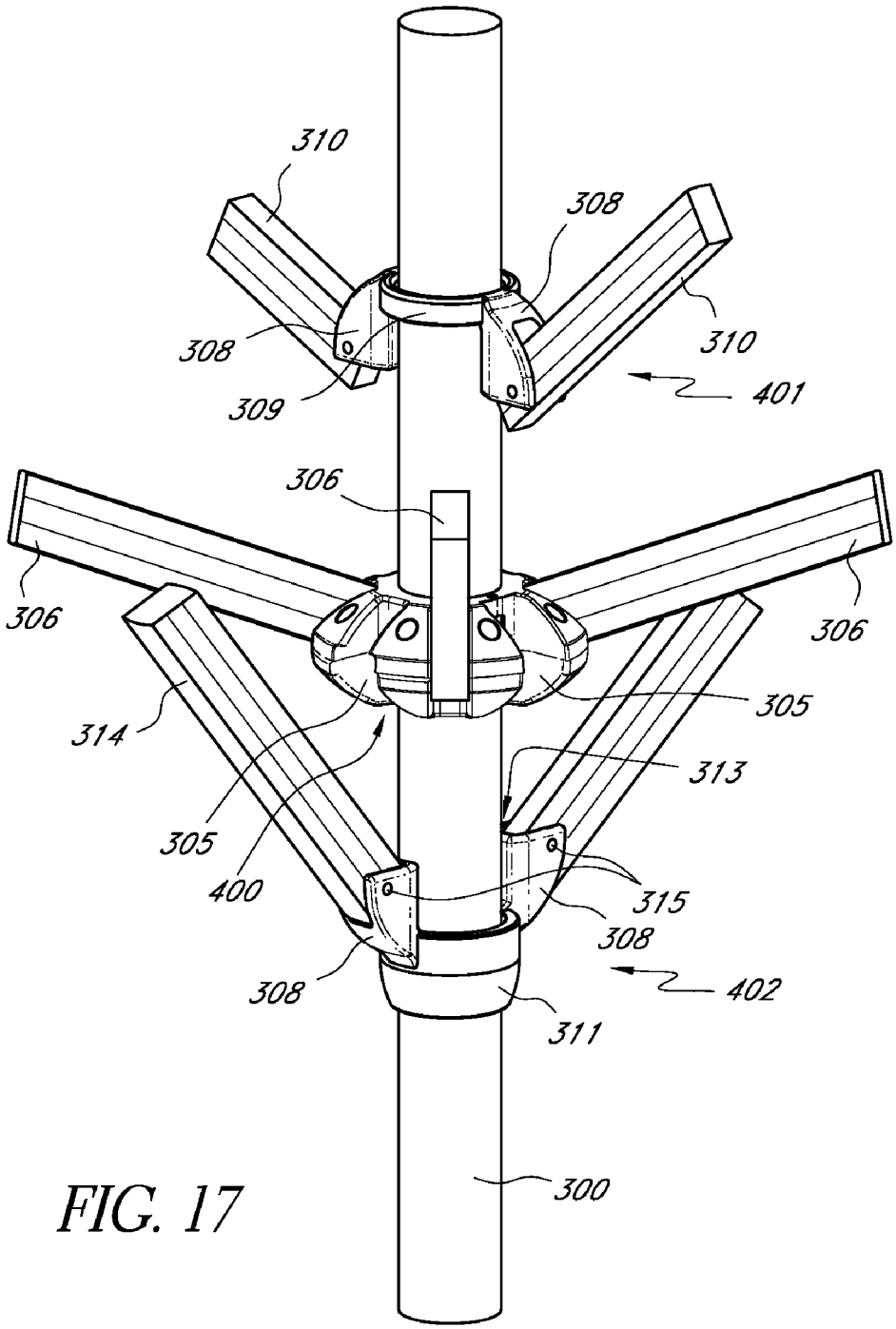
FIG. 17 is a side plan view of the hub arrangement of FIG. 16, showing the hub components separated from one another.

This nested hub arrangement operates similarly to that described above in connection with FIGS. 12 to 15, but will produce a different canopy profile in view of the locations and rib arrangements shown in FIGS. 16 and 17.

Figure 18:
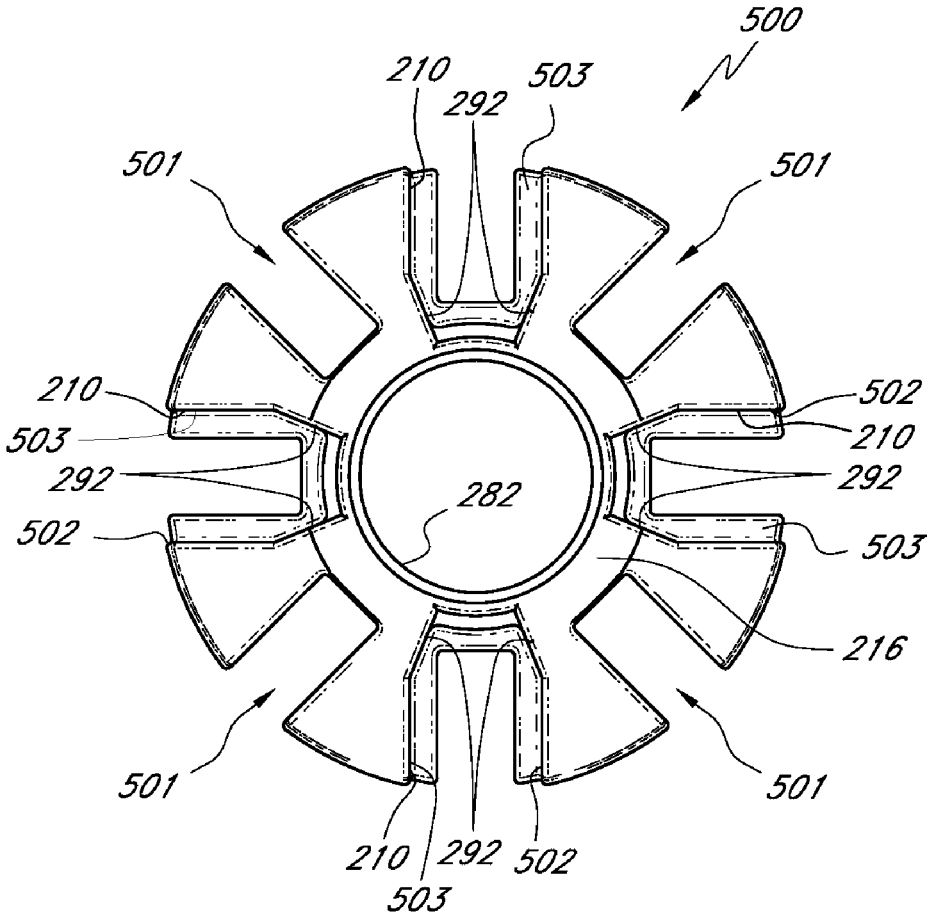
FIG. 18 is a top view of the master hub component or runner shown in FIGS. 12, 13, 16 and 17.

FIG. 18 is a top view of the master hub component 400 shown in FIGS. 16 and 17. Like numerals are used in this figure as common elements in other drawings.

Thus, the illustrated hub component comprises a plurality of generally radially extending recesses 501 for receiving ribs (not shown) and a plurality of other recesses 502 for receiving the yoke-like elements 503 of the other hub components.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella, comprising:

a pole having a longitudinal axis and an uppermost hub with first and second pluralities of ribs extending therefrom for supporting a shade canopy;

a hub below the uppermost hub when the umbrella is erected and comprising separable hub components, the hub comprising a first hub component and a second hub component, the first hub component having an outline shape extending around the pole and comprising a series of projections extending substantially radially with respect to the longitudinal axis and alternating with a series of substantially radially extending recesses formed between the projections, some of the recesses being adapted to receive a first set of ribs for supporting the first plurality of ribs of the umbrella canopy, the second hub component comprising a plurality of yoke elements extending substantially radially with respect to the longitudinal axis of the pole and alternating with recesses of the first hub component, the yoke elements comprising recesses adapted to receive a second set of ribs for supporting the second set of ribs of the umbrella canopy; and at least one handle operably connectable with the uppermost hub and the second hub component, wherein downward movement of the handle causes downward movement of the uppermost hub and the upward movement of the ends of the first plurality of ribs, and wherein upward movement of the second hub component causes upward movement of ends of the second plurality of ribs relative to the ends of the first plurality of ribs to modify a profile of the canopy.

2. The umbrella of claim 1, wherein the ribs of the first and at least one other hub components are connected to their respective hub components so that they each pivot about a pivot point and wherein the pivot points of the ribs of the first hub component and at least one other hub component are in substantially the same plane when the hub components are nested or embedded together.

3. An umbrella of claim 1, wherein the first and at least one other hub components have complementary shapes, so that when they are nested or embedded together they form an overall external shape that looks like a single hub.

4. An umbrella of claim 1, wherein the hub below the uppermost hub has two hub components: a first hub component and a second hub component.

5. An umbrella of claim 4, wherein the first hub component is in an upper position with respect to the second hub component when the umbrella is erected and the second hub component has a number of yoke elements corresponding to the number of ribs that it carries.

6. An umbrella of claim 4, wherein the first hub component has two ribs and the second hub component has four ribs.

7. An umbrella of claim 1, wherein the hub below the uppermost hub has three hub components: an upper hub component, a lower hub component and an intermediate hub component.

8. An umbrella of claim 7, wherein the lower hub component has two ribs.

9. An umbrella of claim 7, wherein the intermediate hub component has four ribs.

10. An umbrella of claim 7, wherein the intermediate hub component has two ribs.

11. An umbrella of claim 10, wherein the upper hub component has four ribs.

12. An umbrella of claim 1, wherein the at least one handle comprises first and second handles that are connected with the respective ones of the uppermost hub and the second hub component.

13. An umbrella of claim 12, wherein downward movement of the first handle causes downward movement of the uppermost hub to move the ends of the first plurality of ribs, and wherein downward movement of the second handle causes upward movement of the second hub component to move the ends of the second plurality of ribs relative to the ends of the first plurality of ribs to modify a profile of the canopy.

14. An umbrella of claim 1, further comprising a third plurality of ribs and a third hub component, the third hub component comprising a second plurality of yoke elements extending substantially radially with respect to the longitudinal axis of the pole and alternating with recesses of the first hub component and with the yoke elements of the second hub component, the second yoke elements comprising recesses adapted to receive a third set of ribs for supporting the third set of ribs of the umbrella canopy.

15. An umbrella of claim 1, wherein the projections and at least some of the yokes lie in a common horizontal plane in an open position.

16. An umbrella of claim 1, wherein the projections and the yokes lie in separate horizontal planes in a fully open position.

17. An umbrella of claim 1, wherein the projections and at least some of the yokes lie in a common horizontal plane in a closed position.

18. An umbrella of claim 1, wherein the first hub component is fixed relative to the pole.

19. An umbrella of claim 1, wherein the first handle is coupled to the uppermost hub via an elongate member.

20. An umbrella of claim 1, wherein the second handle is coupled to the second hub component via a pulley assembly.

* * * * *

UNITED STATES PATENT AND TRADEMARK OFFICE

CERTIFICATE OF CORRECTION

PATENT NO. : 7,900,643 B2
APPLICATION NO. : 11/850640
DATED : March 8, 2011
INVENTOR(S) : Oliver Joen-an Ma It is certified that error appears in the above-identified patent and that said Letters Patent is hereby corrected as shown below:

At Column 3, Line 34, please change "yolk" to --yoke--.

At Column 3, Line 35, please change "yolk" to --yoke--.

At Column 3, Line 47-67 please change "Another embodiment of the invention provides an umbrella, comprising a pole having a longitudinal axis and an upper hub with a plurality of ribs extending therefrom for supporting a shade canopy; a hub below the upper hub when the umbrella is erected and comprising separable hub components, comprising a first hub component having an outline shape extending around the pole and comprising a series of projections extending substantially radially with respect to the longitudinal axis and alternating with a series of substantially radially extending recesses formed between the projections, some of the recesses being adapted to receive ribs for directly or indirectly supporting the umbrella canopy and some other of the recesses being adapted to receive, when the hub components are not separated, at least one other (such as a second or second and third) hub component comprising a plurality of yoke elements extending substantially radially with respect to the longitudinal axis of the pole, the yoke elements being configured to nest together with the other recesses of the first hub component and provide recesses adapted to receive a set of ribs carried by the at least one other hub component(s)."

to --In some preferred embodiments of the invention, the additional hub may comprise two, three or four hub components. Typically, these hubs will comprise a master hub component. The master hub preferably is the hub component carrying the most ribs compared to the other components. The master hub component typically is the principal component of the nested hub arrangement into which the other hub component or components nest. Thus, preferably, the master hub component comprises a body extending around the umbrella pole and having formed therein a plurality of radially extending recesses. Some of the recesses accept ribs and other of the recesses accept other hub components for Signed and Sealed this
Fourteenth Day of February, 2012

David J. Kappos

David J. Kappos
*Director of the United States Patent and Trademark Office* nesting. Preferably the master hub component has two or four recesses for receiving for nesting rib-carrying projections elements of one or more hub components. Such master hub components may carry six or four, respectively, ribs of its own.--.

At Column 4, Line 5, please change “yolk” to --yoke--.

At Column 4, Line 27-34 please change “In one embodiment, the at least one other hub has two hub components. The first hub component may be in an upper position with respect to the second hub component when the umbrella is erected and the second hub component has a number of yoke elements corresponding to the number of ribs that it carries. The first hub component may have two ribs and the second hub component four ribs.”

to --Accordingly, the invention provides nested hubs that may comprise two, three or four separable hub components. In some preferred embodiments, the two component hub may have an upper hub component with two ribs and lower hub component with four ribs; the three component hub may have an upper hub component with two or four ribs and lower hub component with two ribs and an intermediate hub component with four or two ribs, respectively; the four component hub may have four hub component each with two ribs.--.